US007950439B2

(12) United States Patent
Anderson

(10) Patent No.: US 7,950,439 B2
(45) Date of Patent: May 31, 2011

(54) COMBINATION-ACTION SLIDE AND HINGE SWINGING DOOR

(76) Inventor: Victor Ray Anderson, Trumbull, CT (US)

( * ) Notice: Subject to any disclaimer, the term of this patent is extended or adjusted under 35 U.S.C. 154(b) by 517 days.

(21) Appl. No.: 11/563,373

(22) Filed: Nov. 27, 2006

(65) Prior Publication Data

US 2007/0119548 A1 May 31, 2007

Related U.S. Application Data

(60) Provisional application No. 60/739,807, filed on Nov. 28, 2005.

(51) Int. Cl.
*E05D 15/00* (2006.01)

(52) U.S. Cl. ..... 160/211; 160/195; 292/251.5

(58) Field of Classification Search ..... 160/211, 160/195; 49/164; 292/231
See application file for complete search history.

(56) References Cited

U.S. PATENT DOCUMENTS

| | | | | | |
|---|---|---|---|---|---|
| 4,484,761 | A * | 11/1984 | Knabel et al. | ..... | 280/612 |
| 4,619,074 | A * | 10/1986 | Leung et al. | ..... | 49/143 |
| 5,832,980 | A * | 11/1998 | Cianciolo | ..... | 160/197 |
| 6,161,334 | A * | 12/2000 | Goodin | ..... | 49/125 |
| 6,170,195 | B1 * | 1/2001 | Lim | ..... | 49/196 |
| 7,451,802 | B2 * | 11/2008 | Cianciolo et al. | ..... | 160/211 |
| 2007/0119548 | A1 * | 5/2007 | Anderson | ..... | 160/211 |

* cited by examiner

*Primary Examiner* — Blair M. Johnson

(57) ABSTRACT

By providing a door wherein the components forming a multi-panel unit assembly, a support & alignment mechanism, an automatic actuating panel action locking and release mechanism, sliding mechanism and hinges, a dual action door assembly is achieved which assures component engagement that allows the door assembly to operate within controlled confines combining first a sliding action and then a swing action to open the door for full unobstructed access of a range of doorway widths from narrow to ultra-wide while overcoming the support problems, full open access problems and wide swing radii problems consistent with conventional doors.

3 Claims, 32 Drawing Sheets

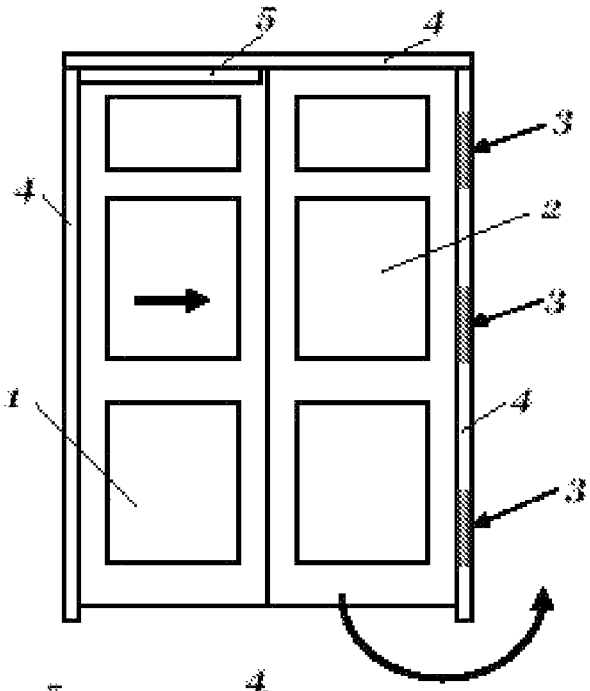
Fig. 1 {a}
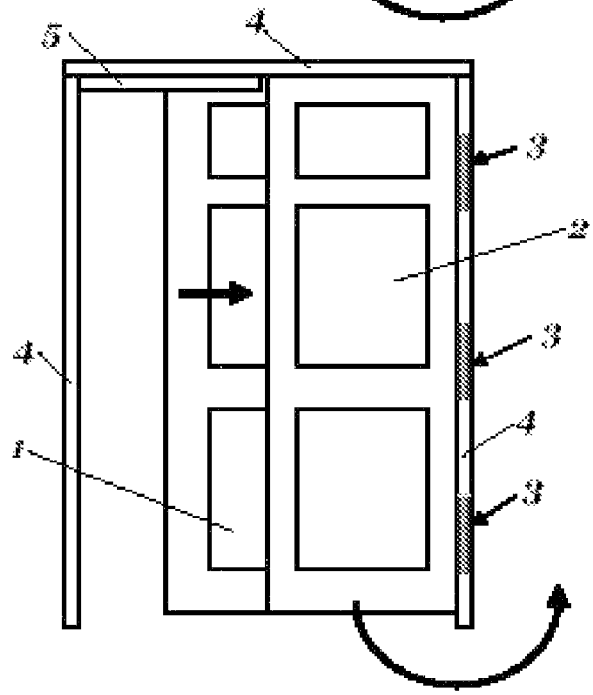
Fig. 1 {b}

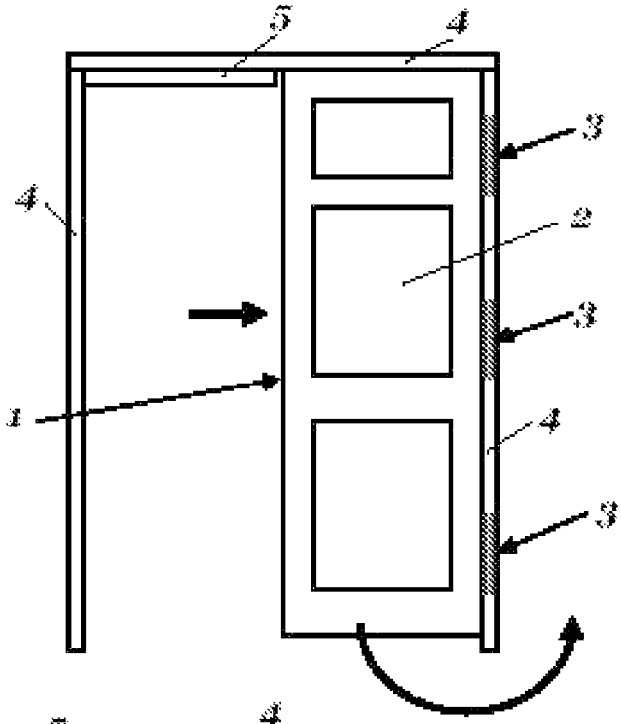
Fig. 1 {c}
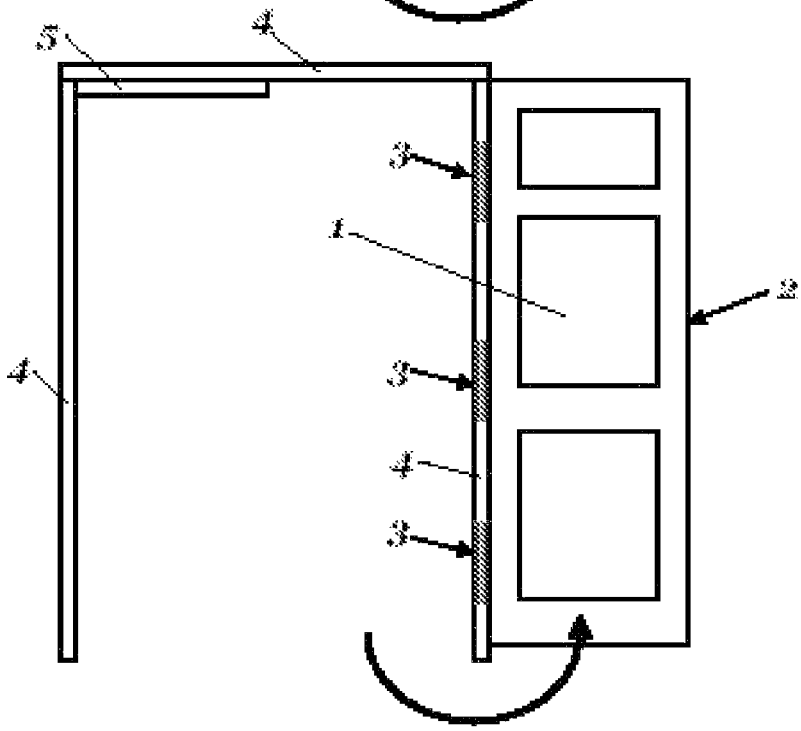
Fig. 1 {d}

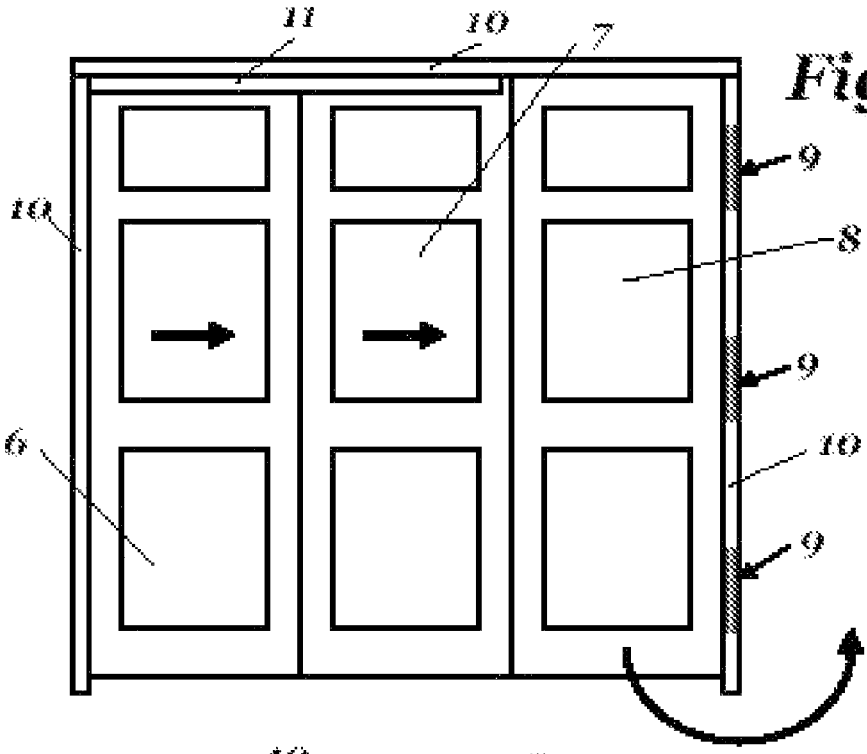
Fig. 2 {a}
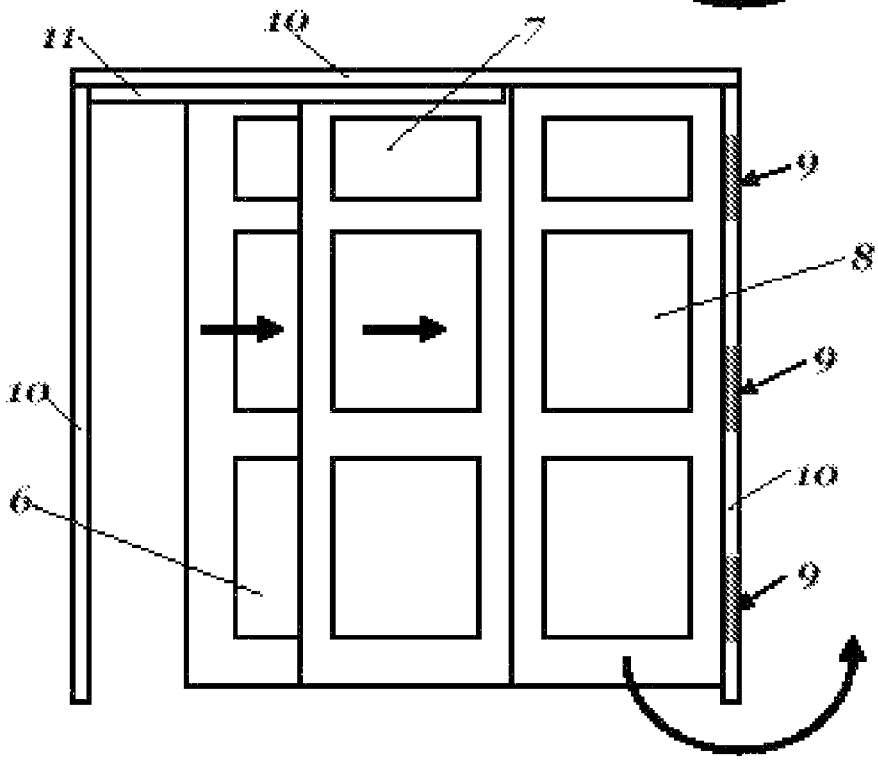
Fig. 2 {b}

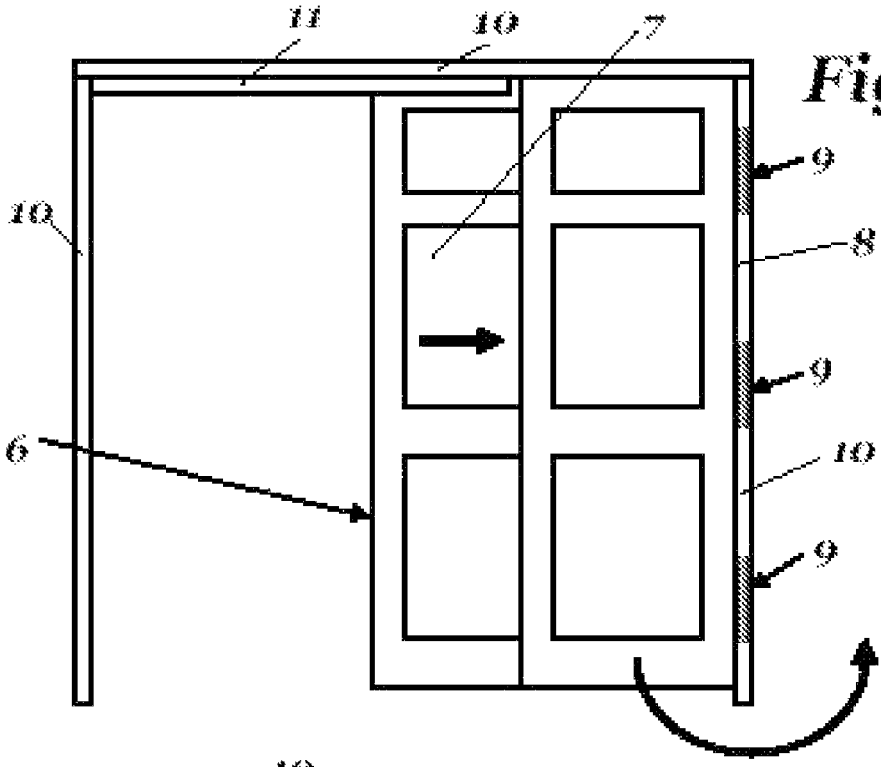
Fig. 2 {c}
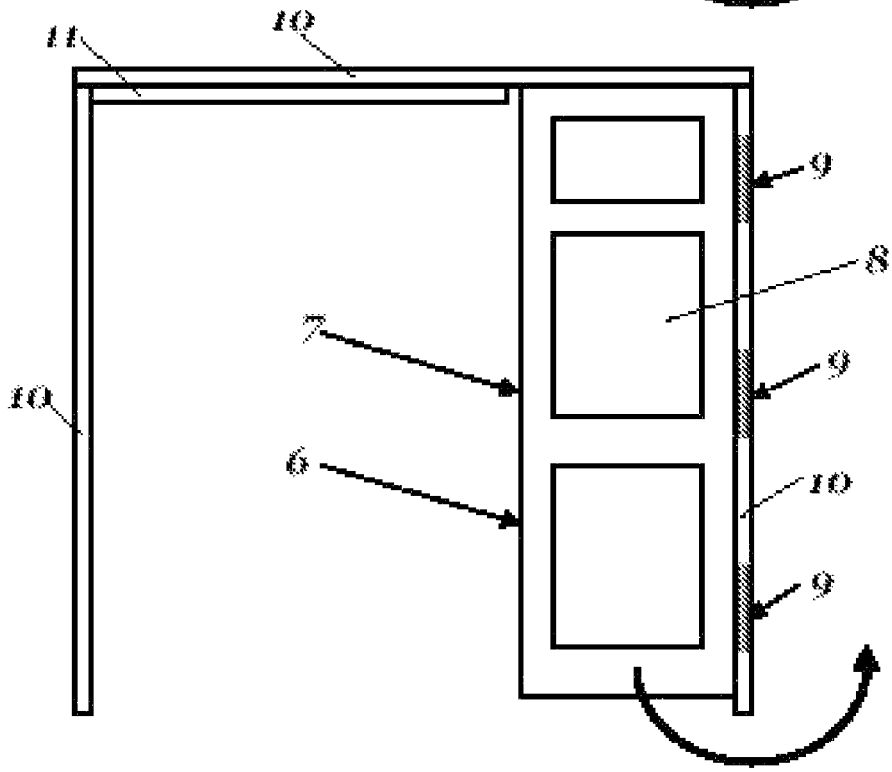
Fig. 2 {d}

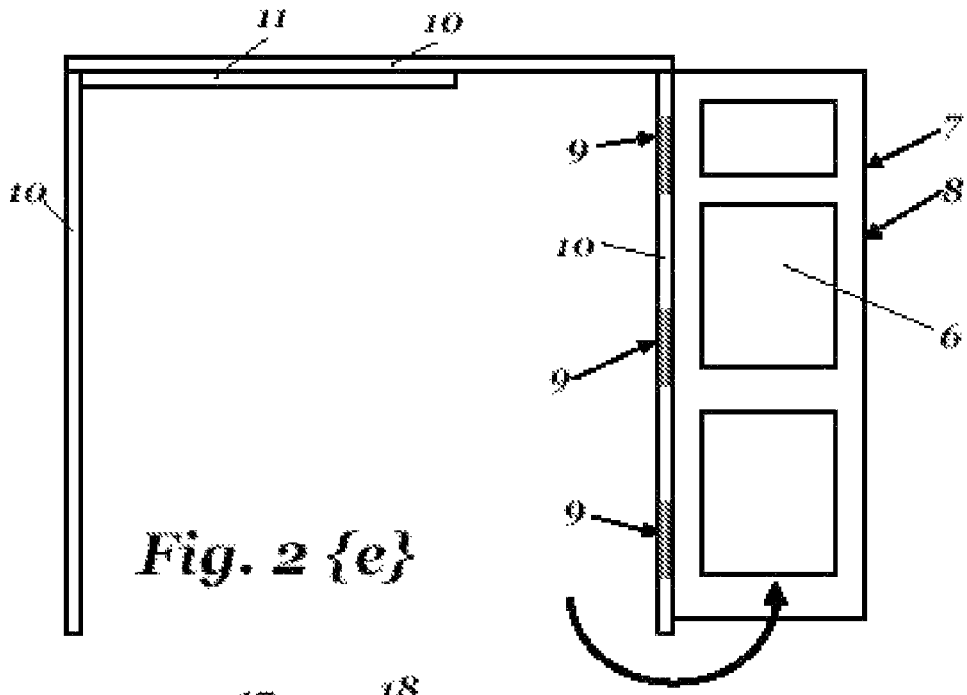
Fig. 2 {e}
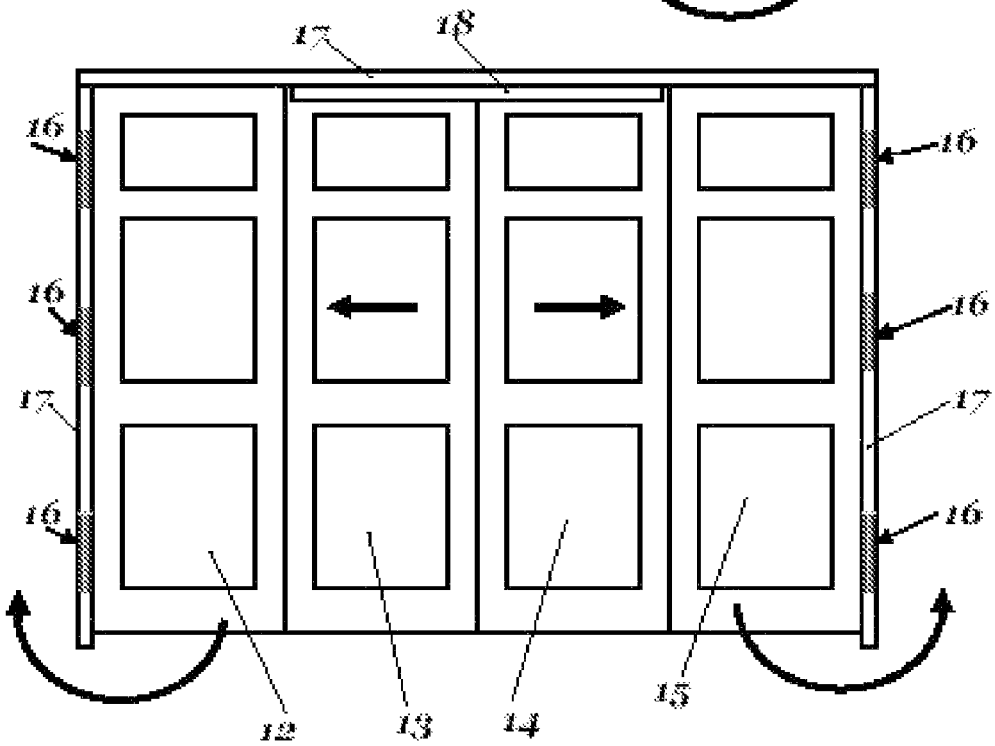
Fig. 3 {a}

Fig. 3 {b}
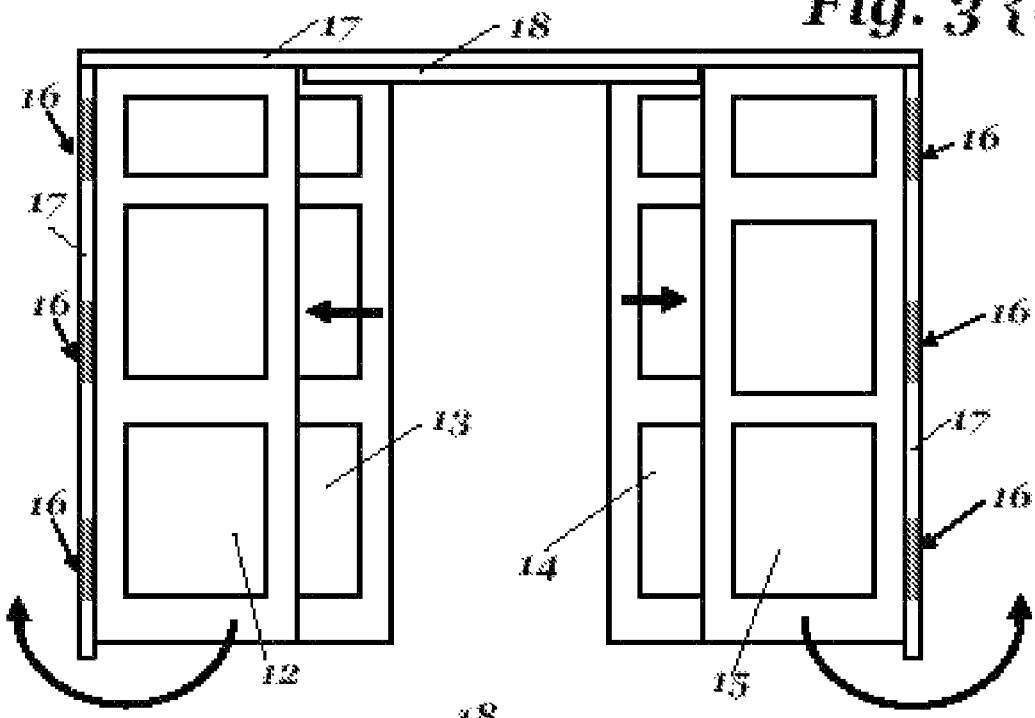
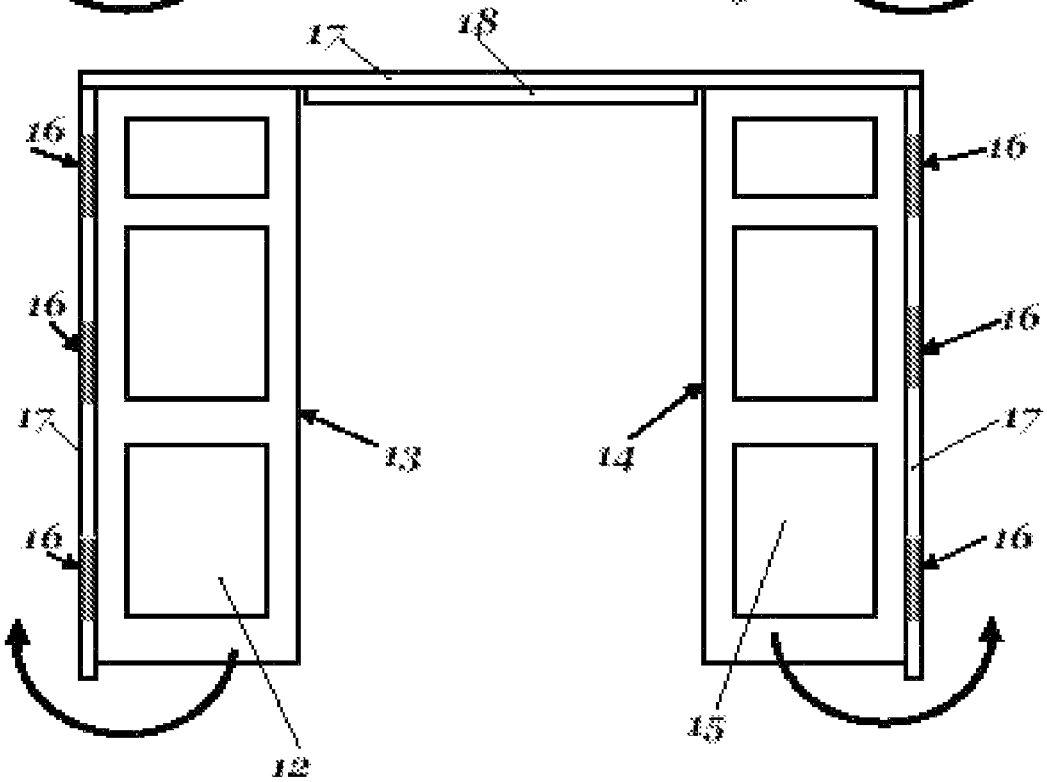
Fig. 3 {c}

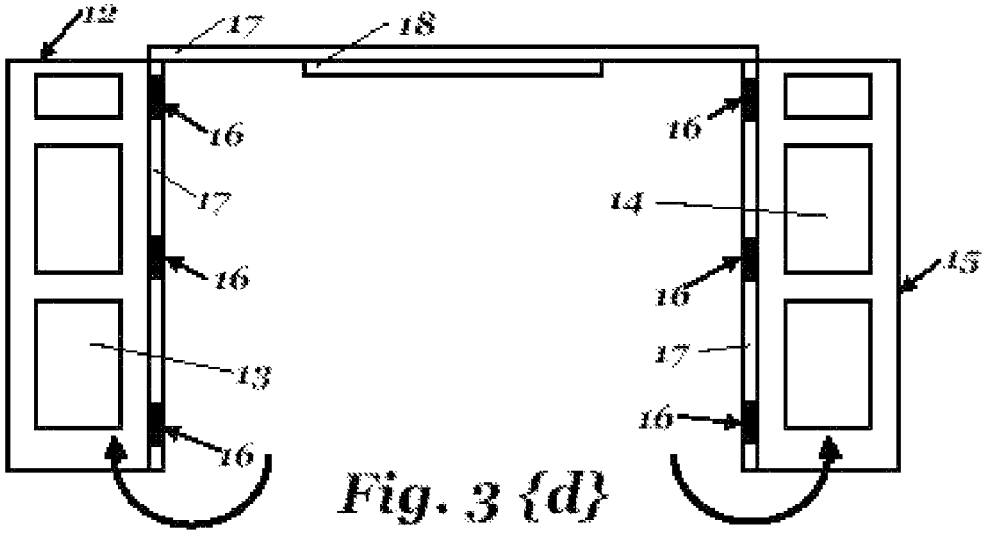
Fig. 3 {d}
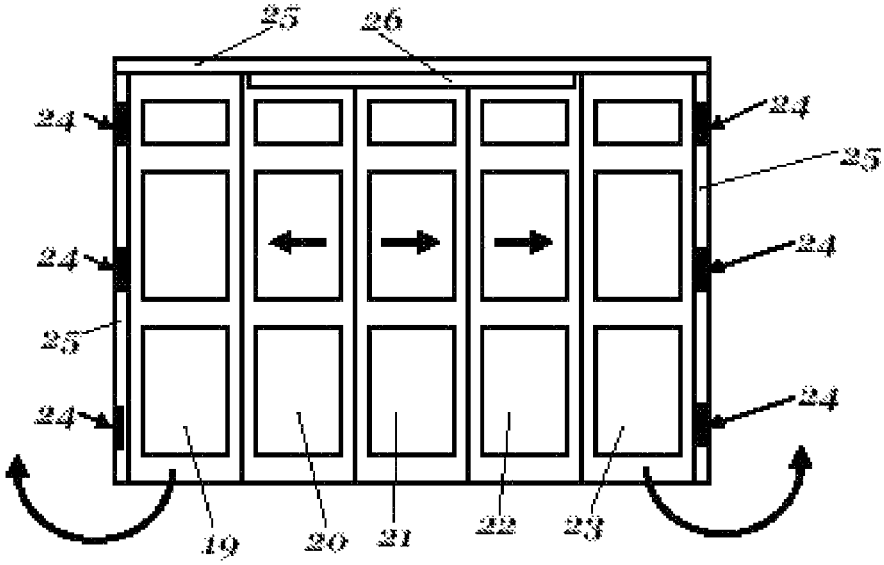
Fig. 4 {a}

Fig. 4 {b}
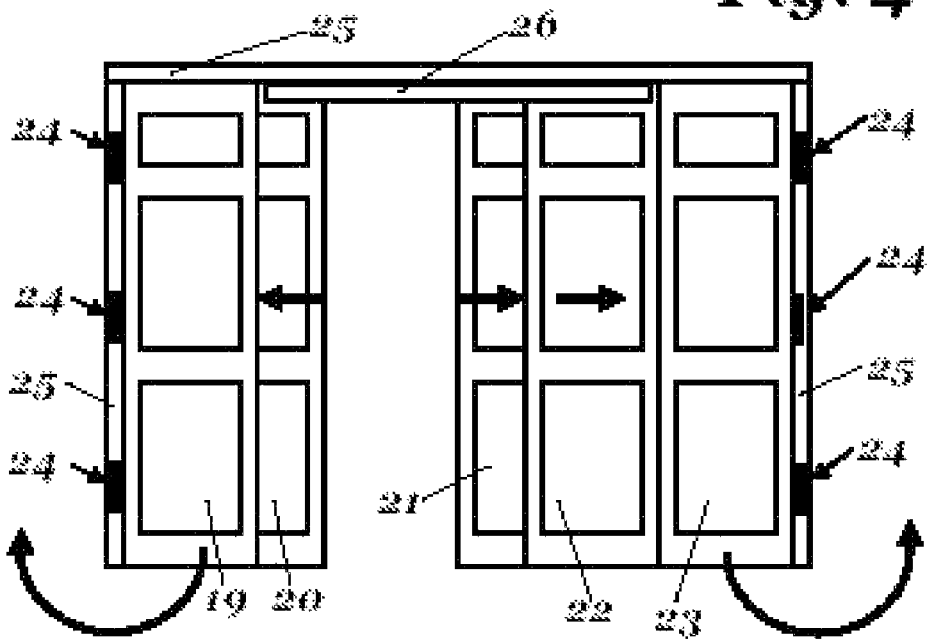
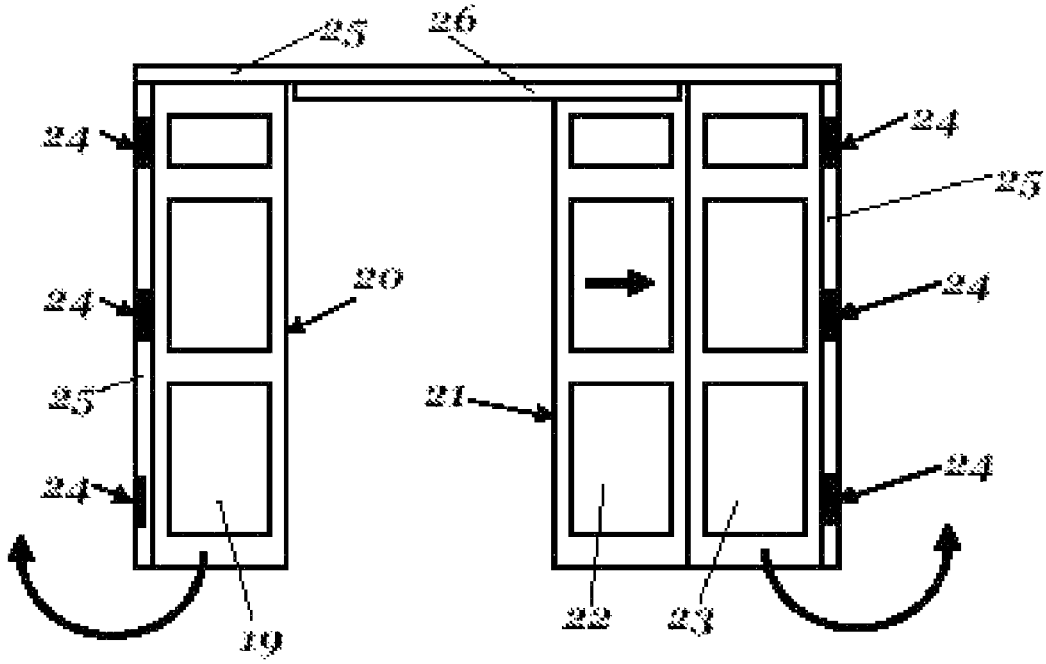
Fig. 4 {c}

Fig. 4 {d}
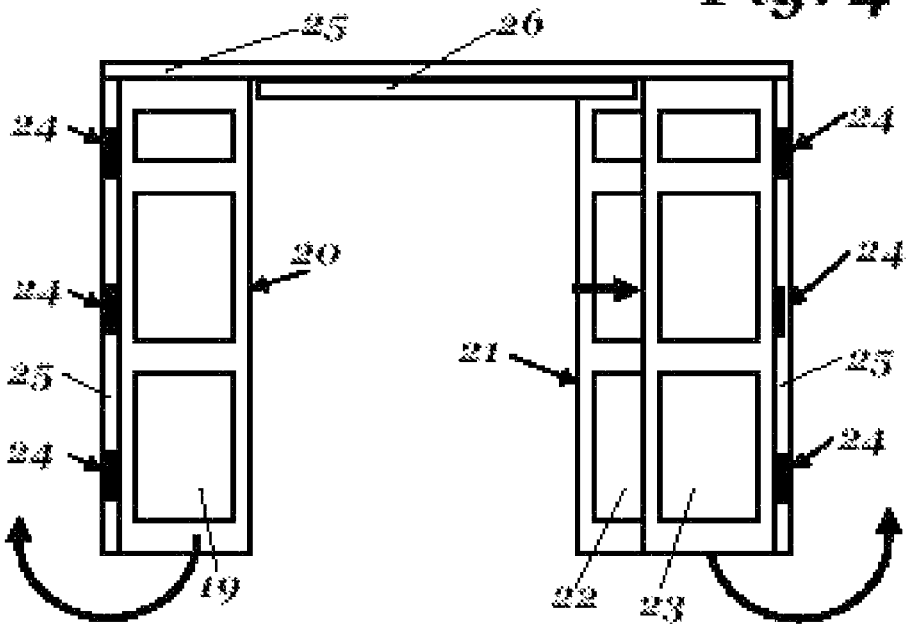
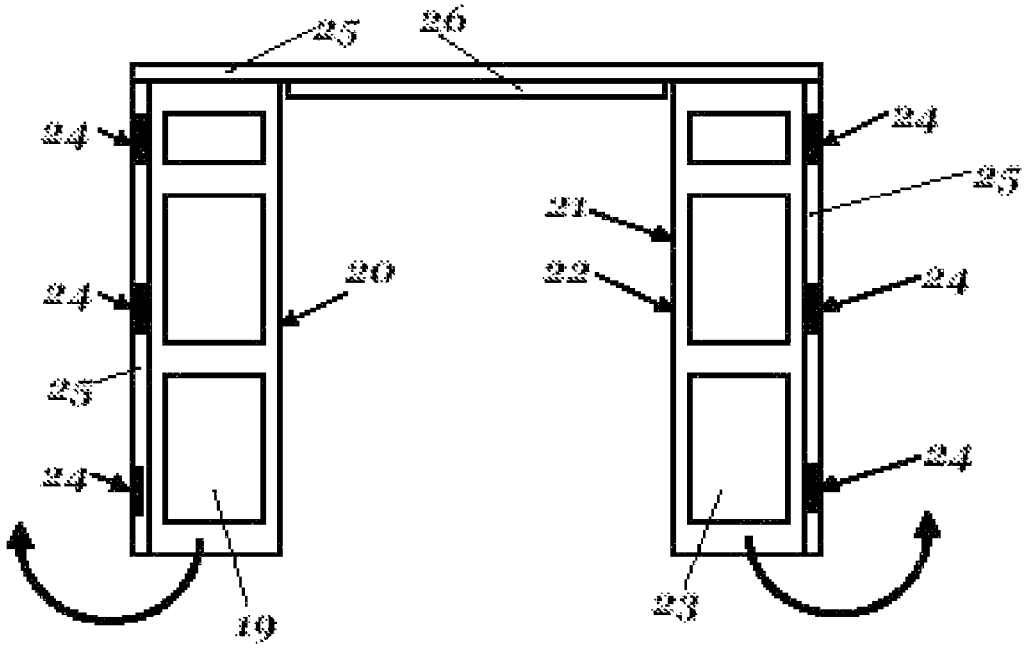
Fig. 4 {e}

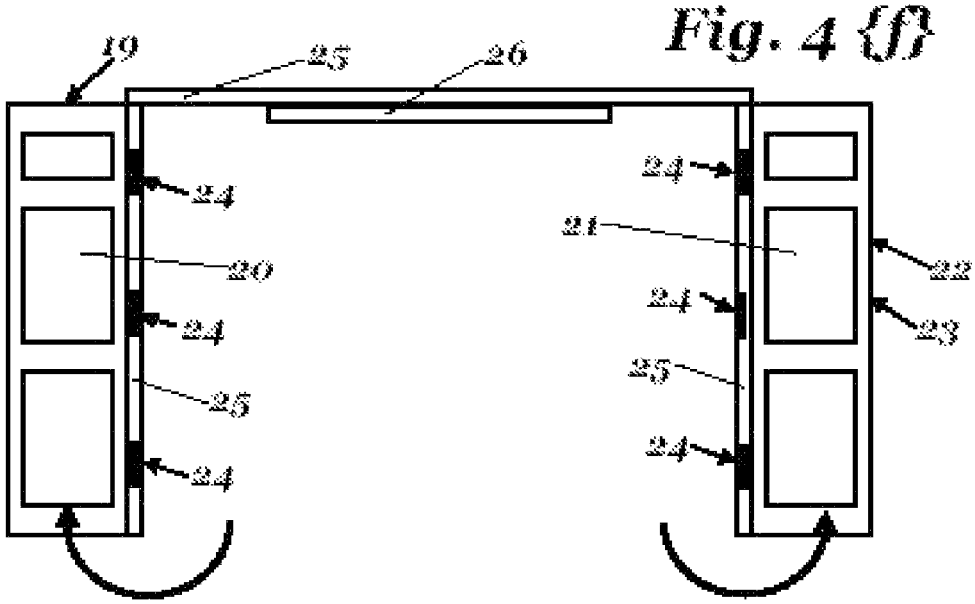
Fig. 4 {f}
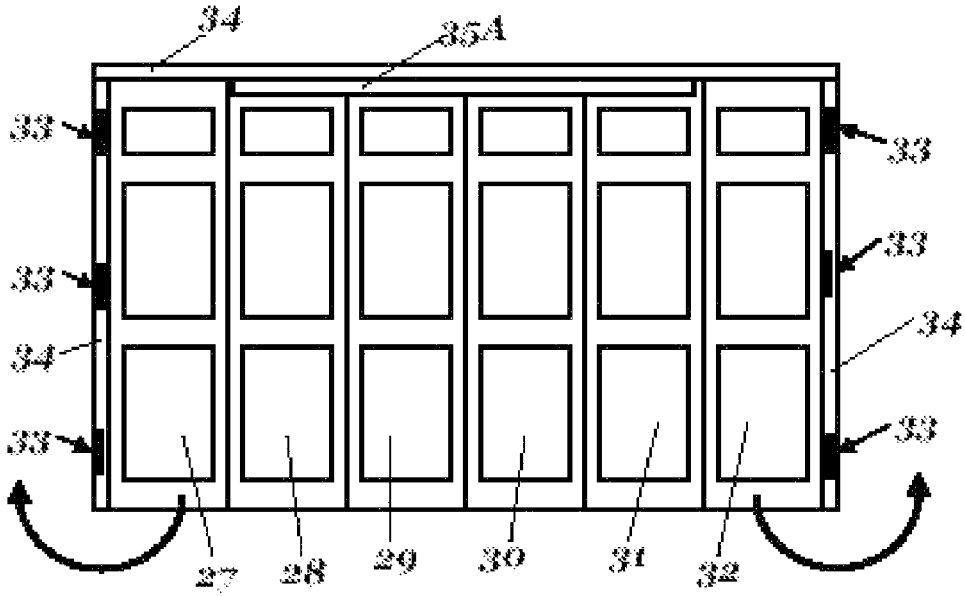
Fig. 5 {a}

Fig. 5 {b}
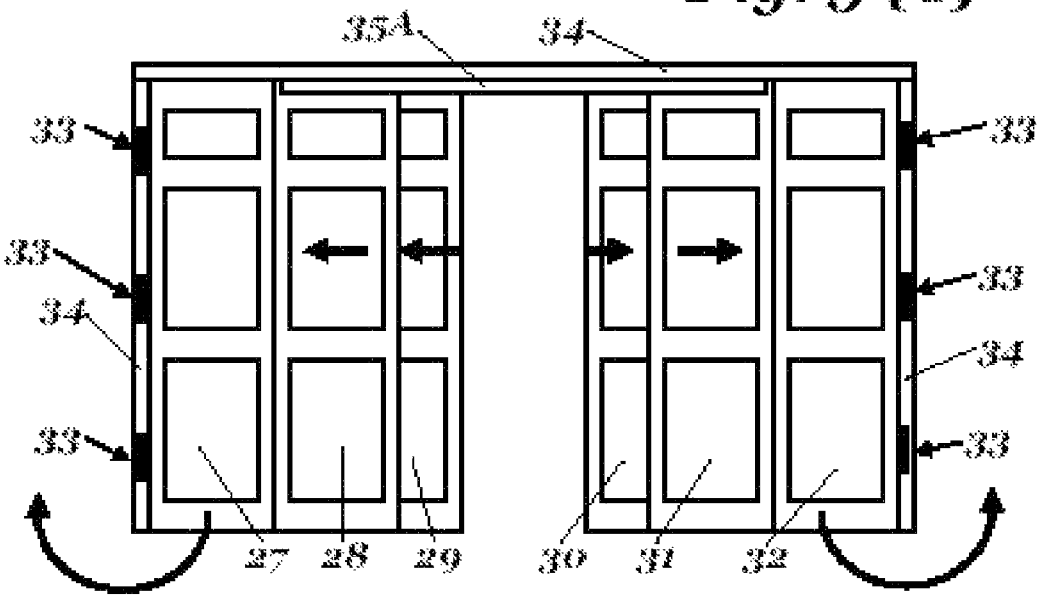
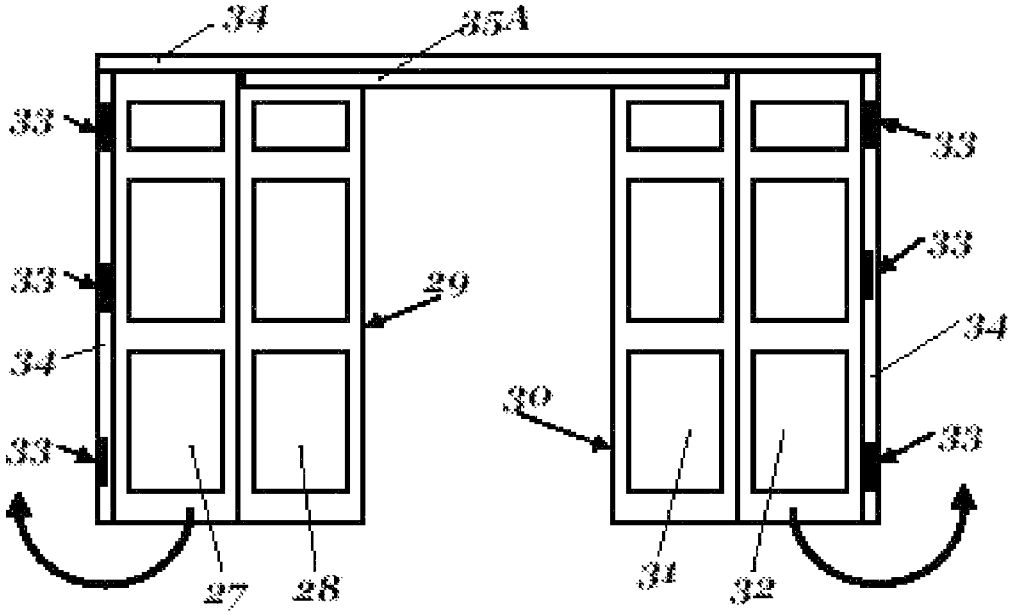
Fig. 5 {c}

Fig. 5 {d}
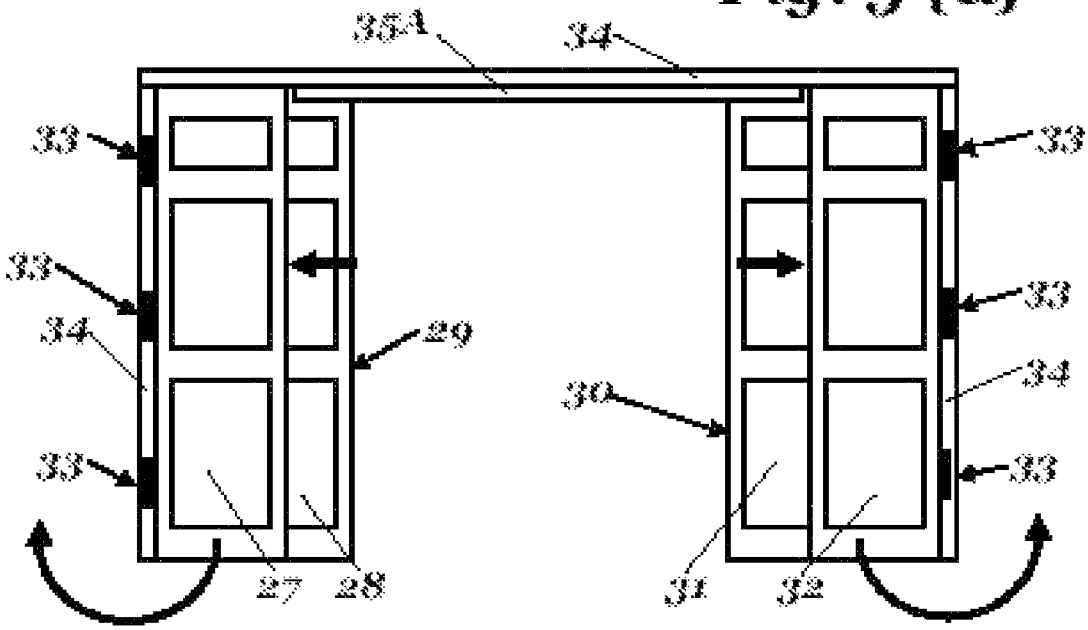
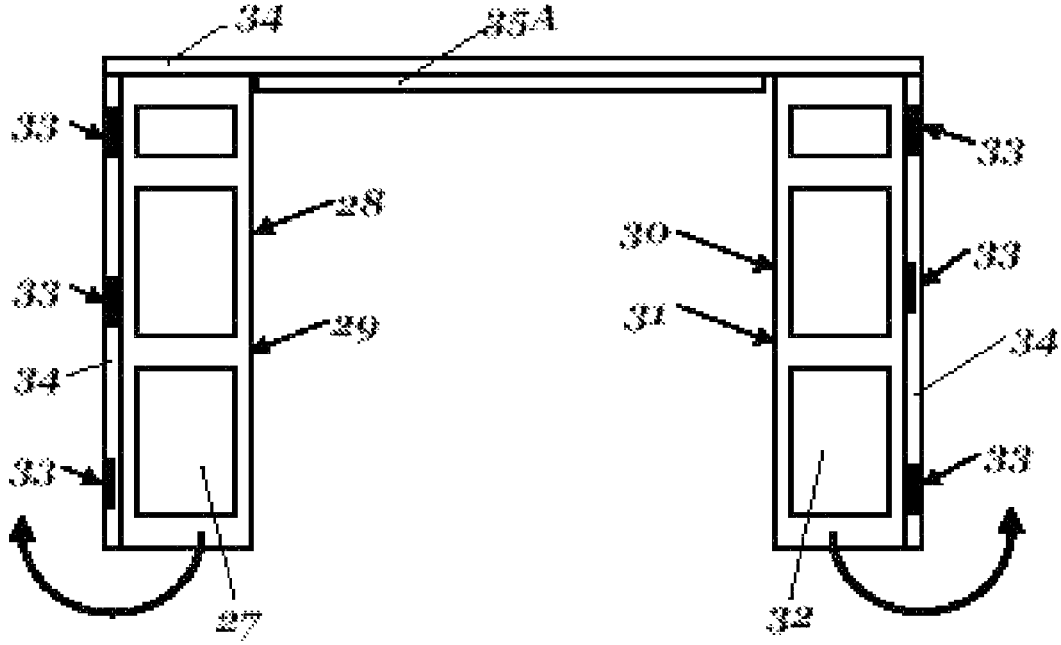
Fig. 5 {e}

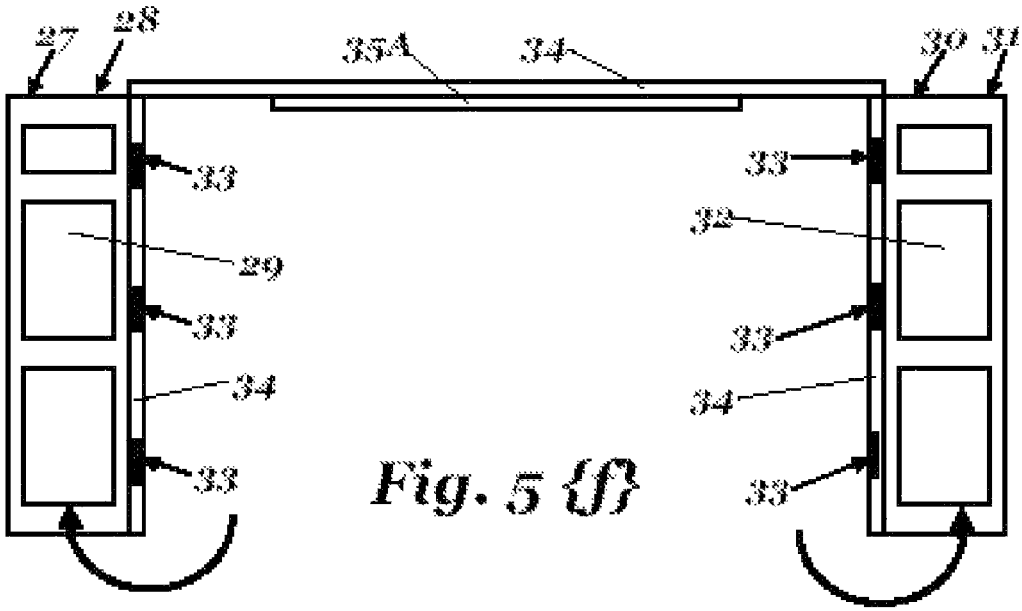
Fig. 5 {f}
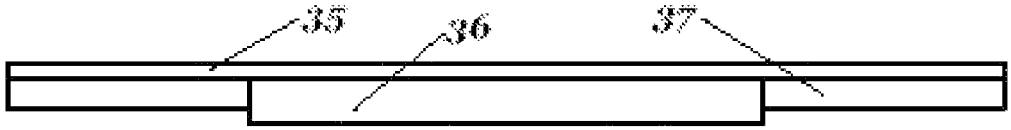
Fig. 6 {a}
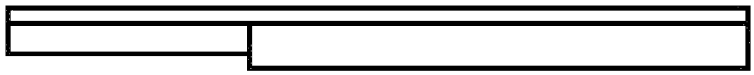
Fig. 6 {b}
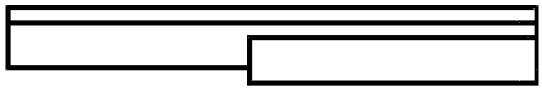
Fig. 6 {c}

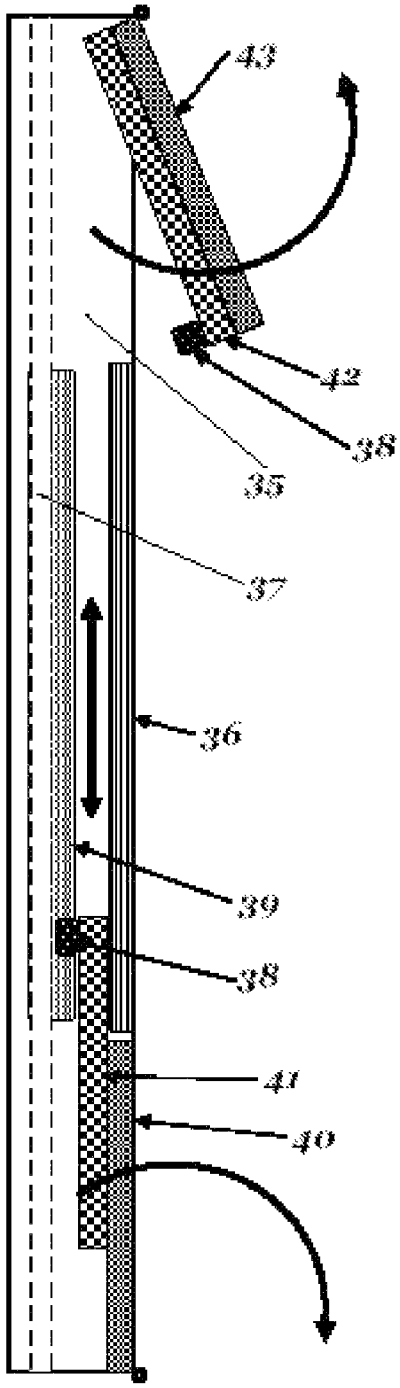
Fig. 6 {d}
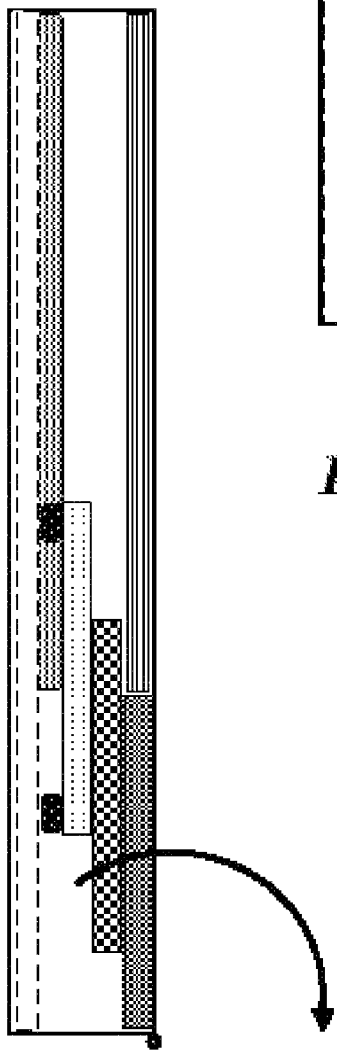
Fig. 6 {e}
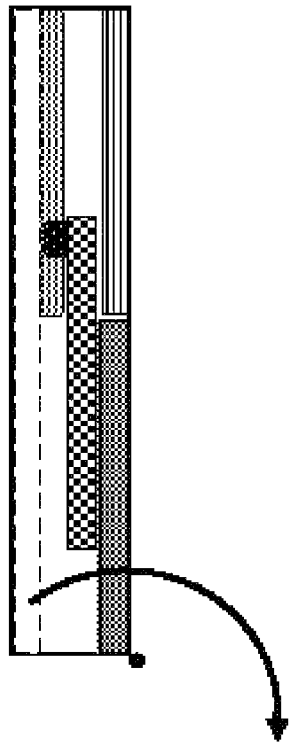
Fig. 6 {f}

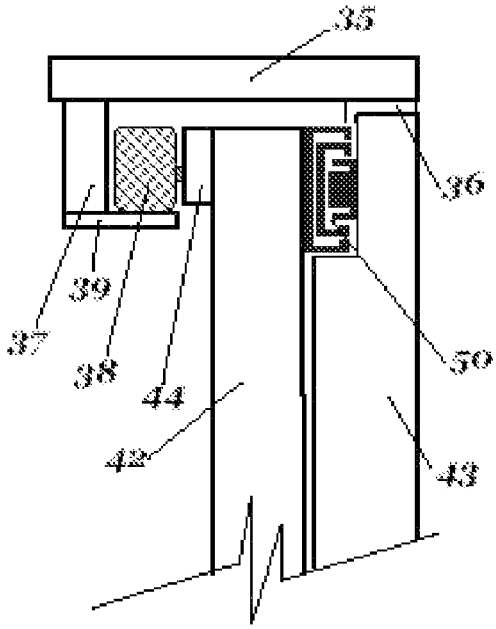
Fig. 6 {g}
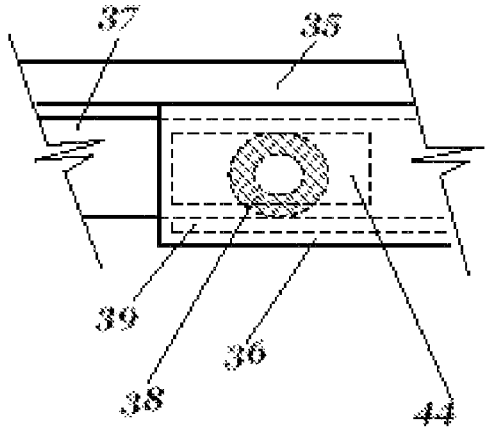
Fig. 6 {h}
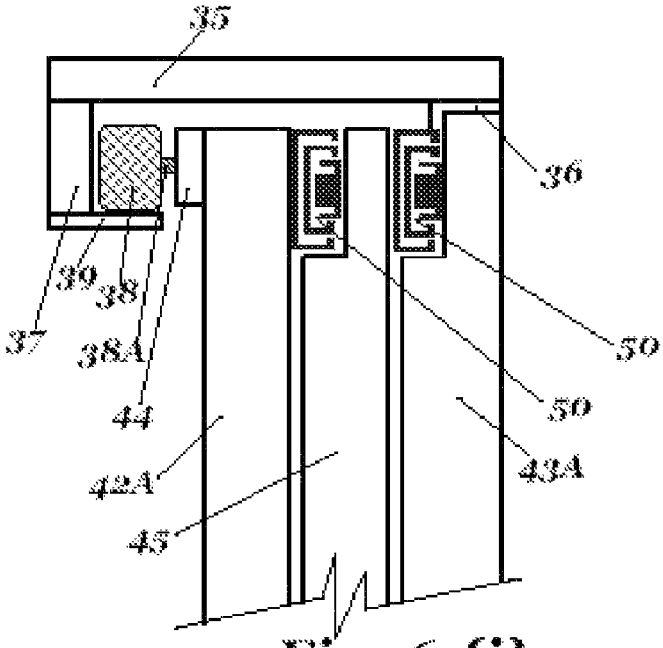
Fig. 6 {i}

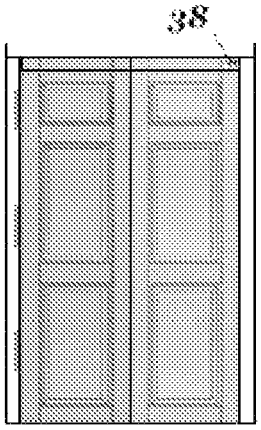
Fig. 6 {j}
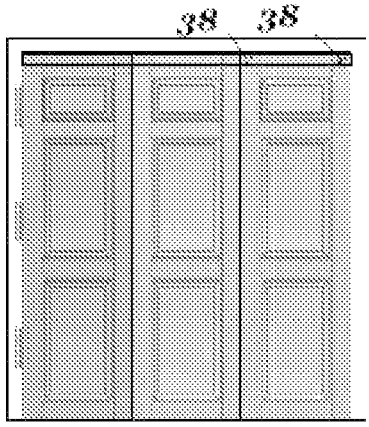
Fig. 6 {k}
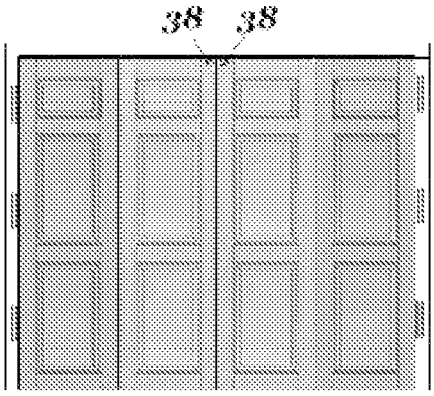
Fig. 6 {l}
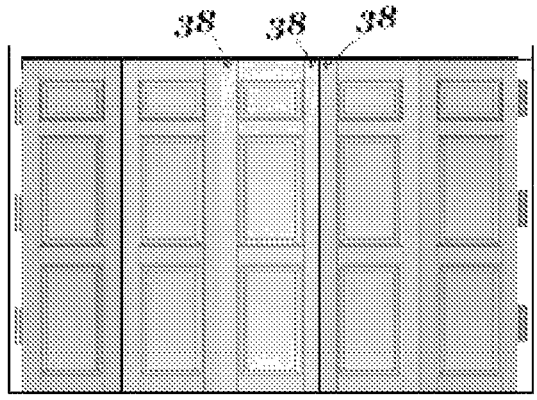
Fig. 6 {m}
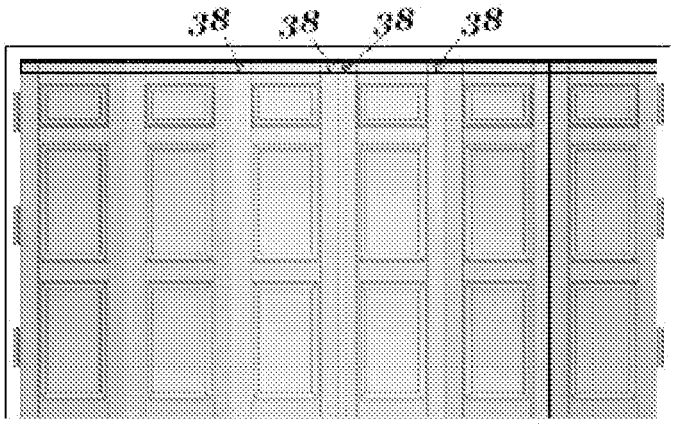
Fig. 6 {n}

Fig. 6 {o}
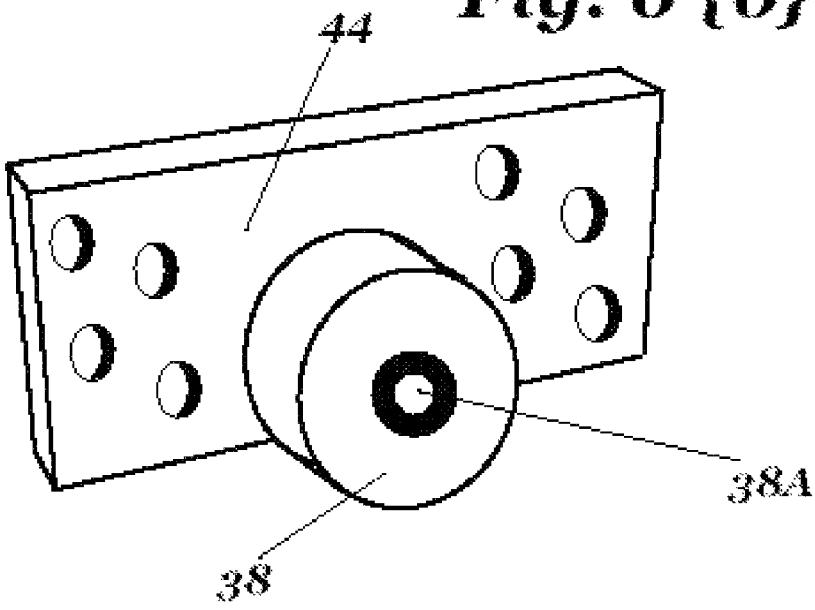
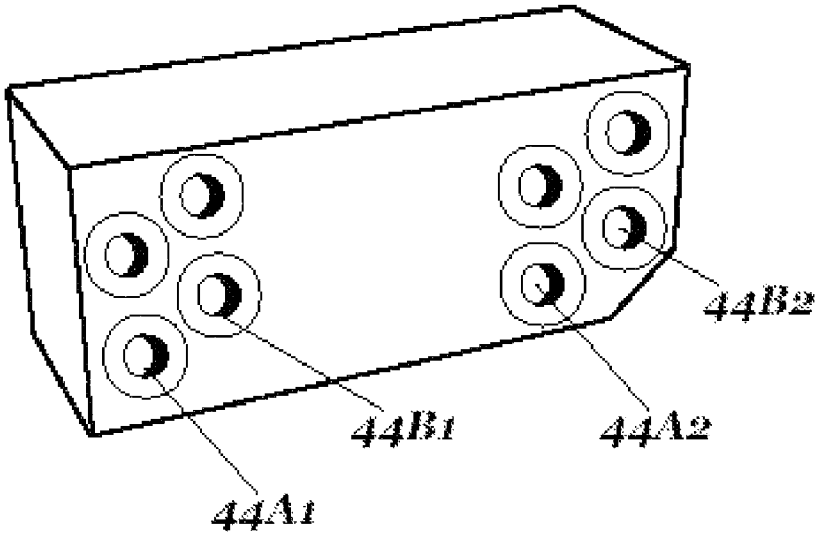
Fig. 6 {p}

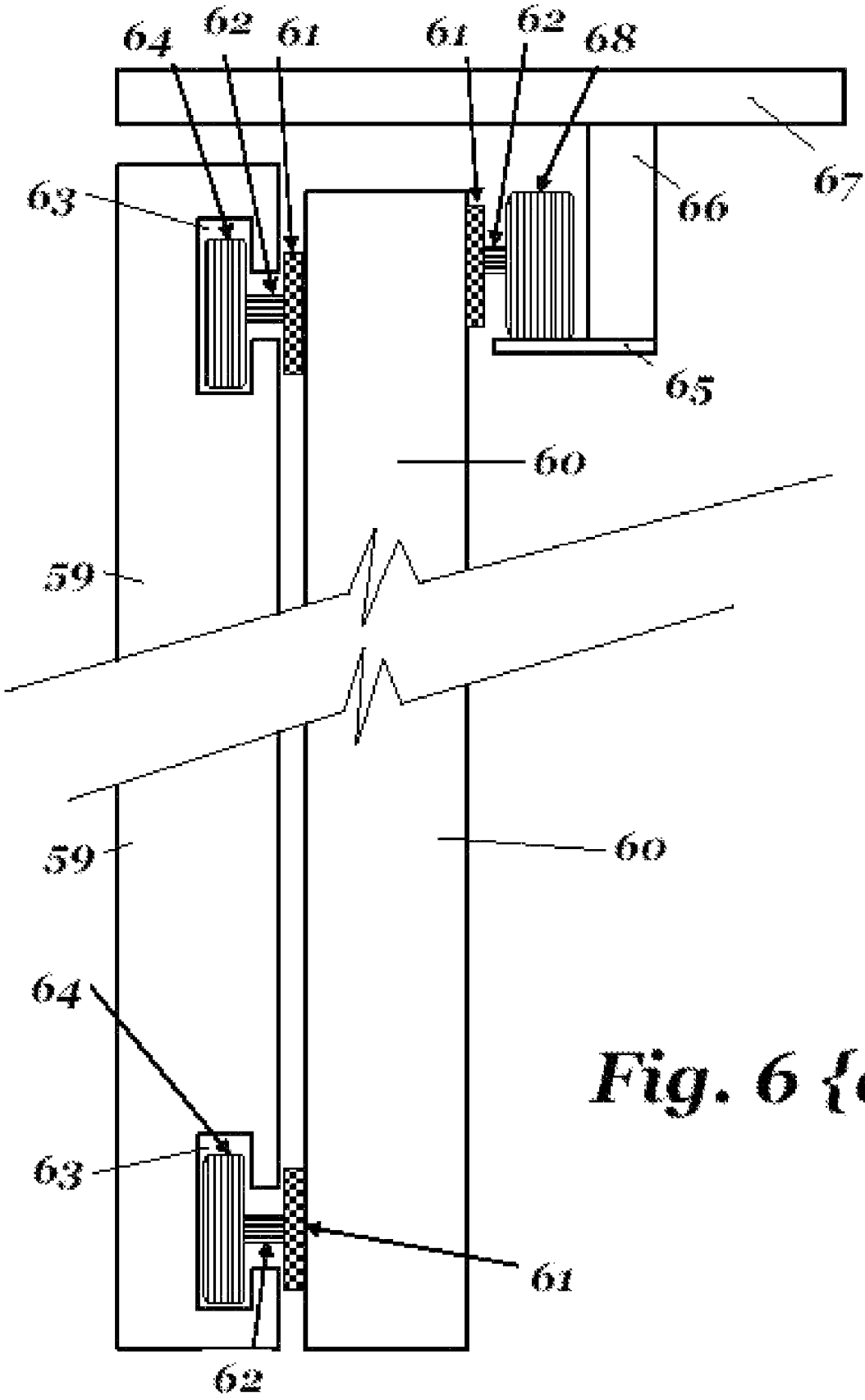
Fig. 6 {q}

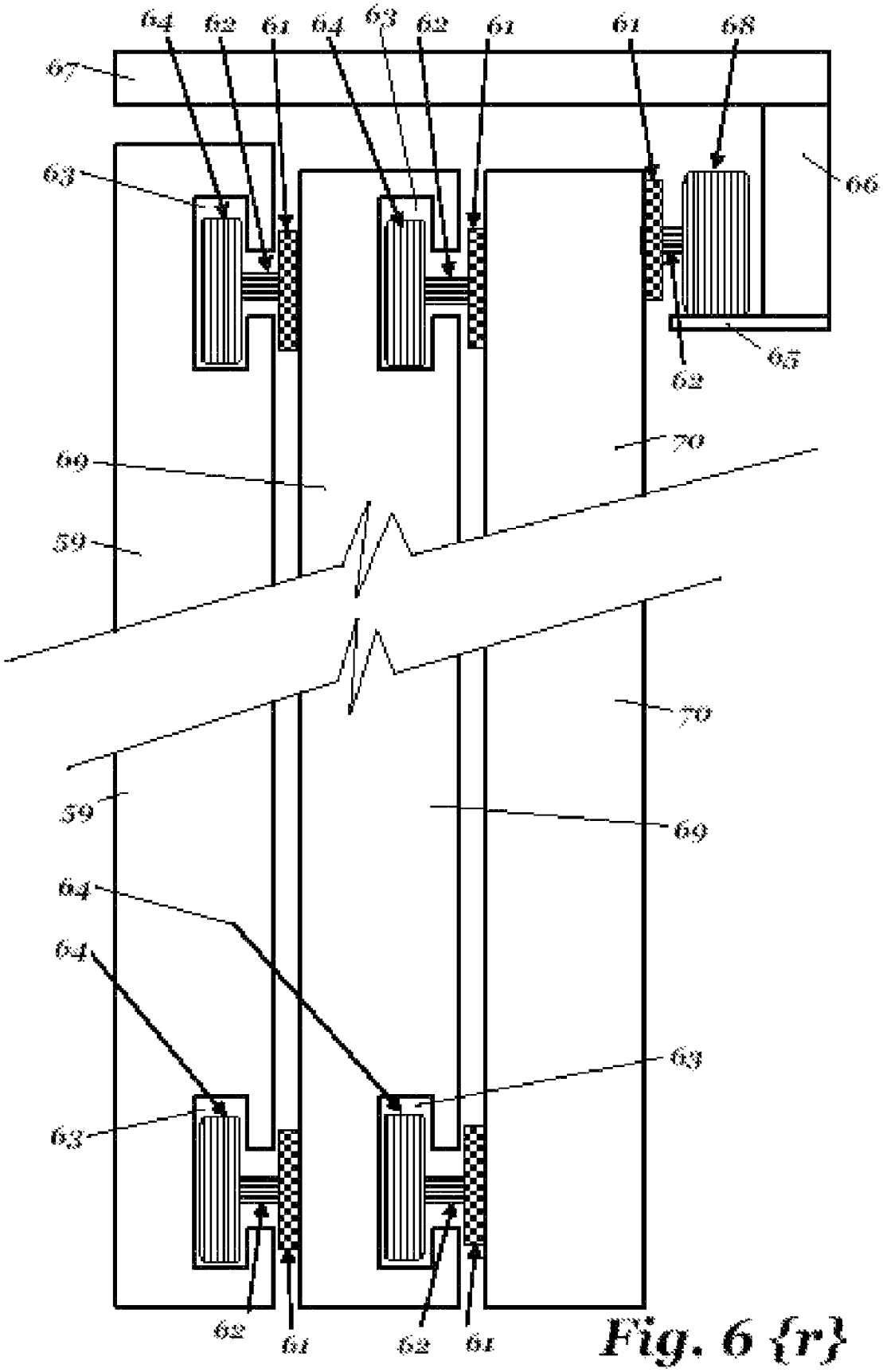
Fig. 6 {r}

Fig. 6 {t}
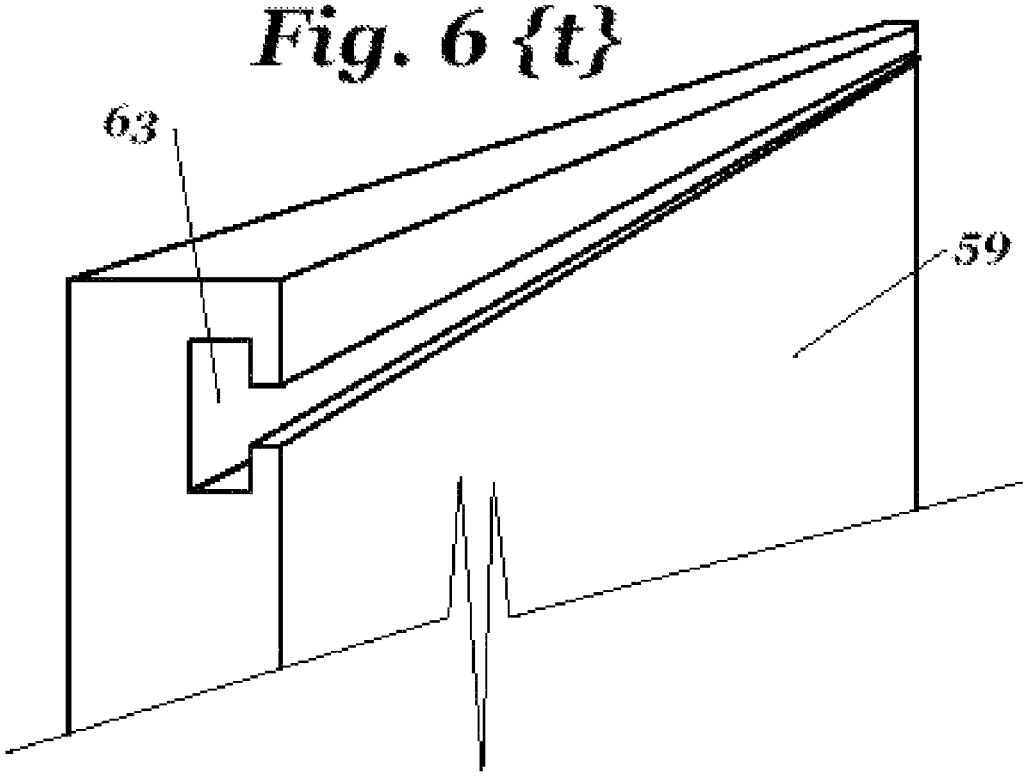
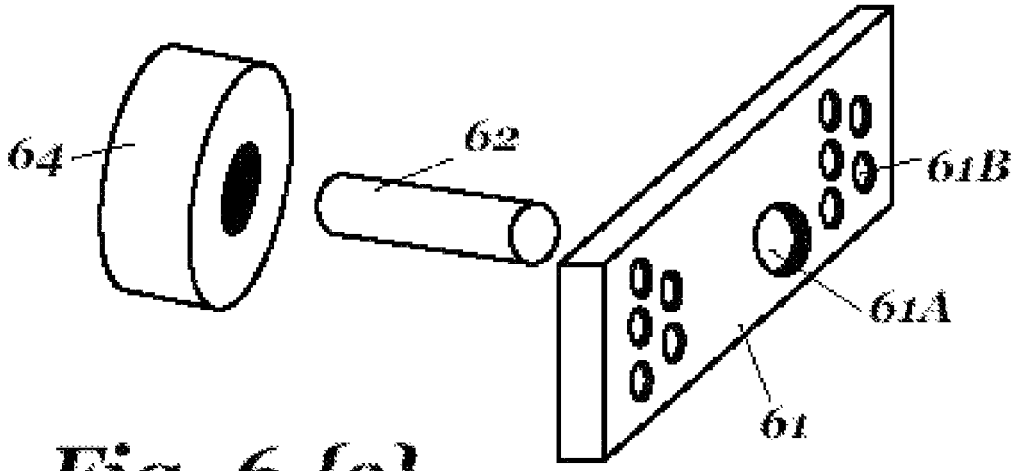
Fig. 6 {s}

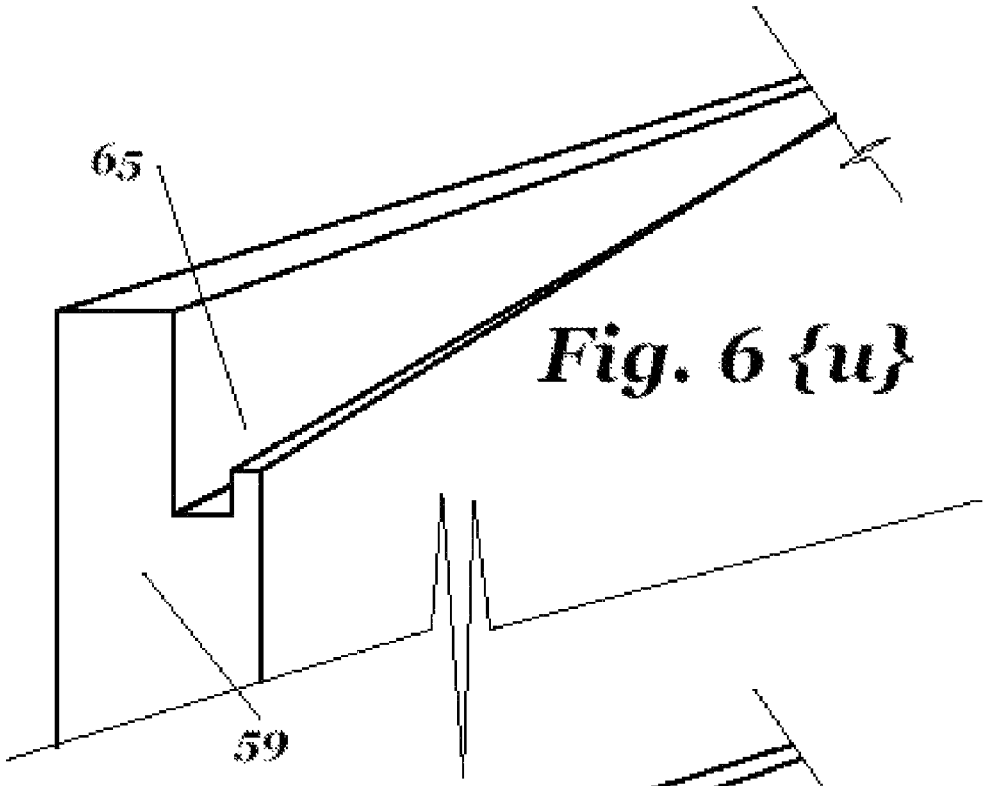
Fig. 6 {u}
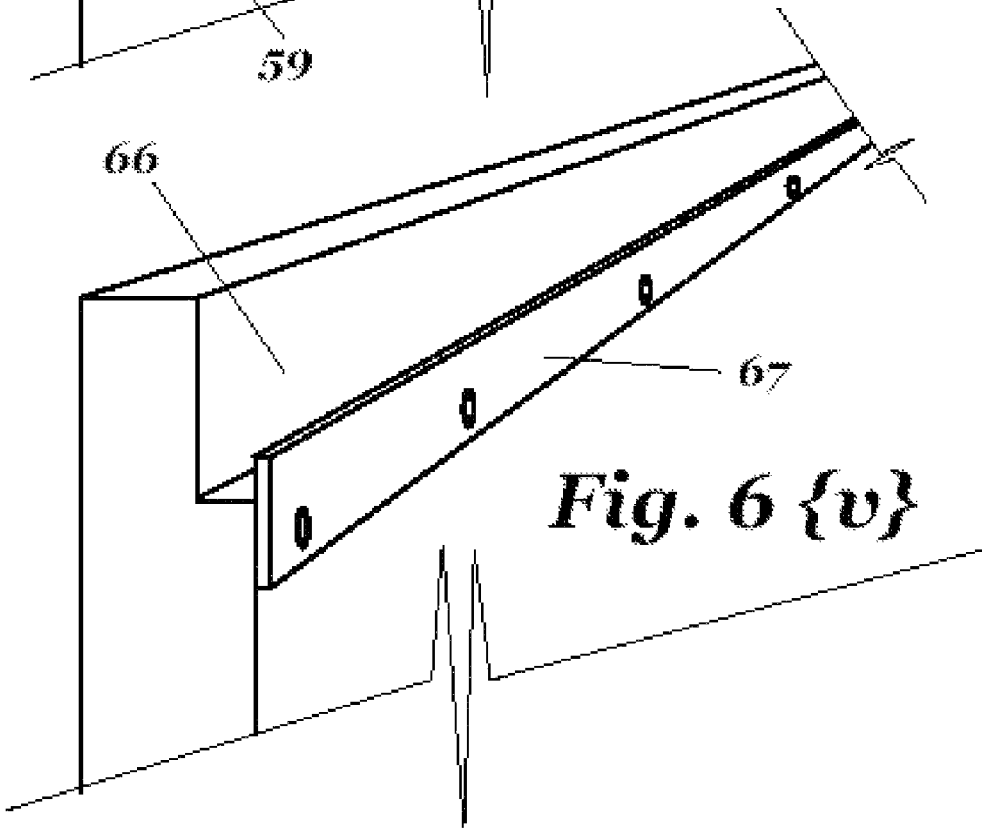
Fig. 6 {v}

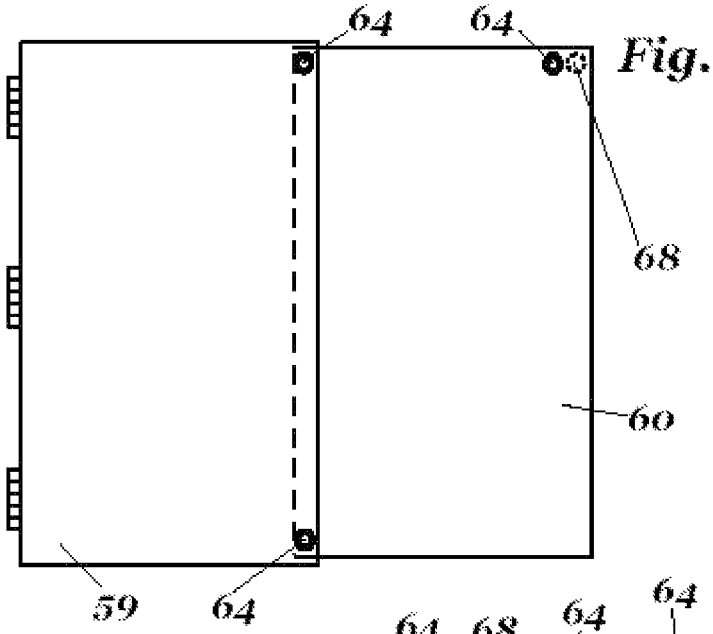
Fig. 6 {w}
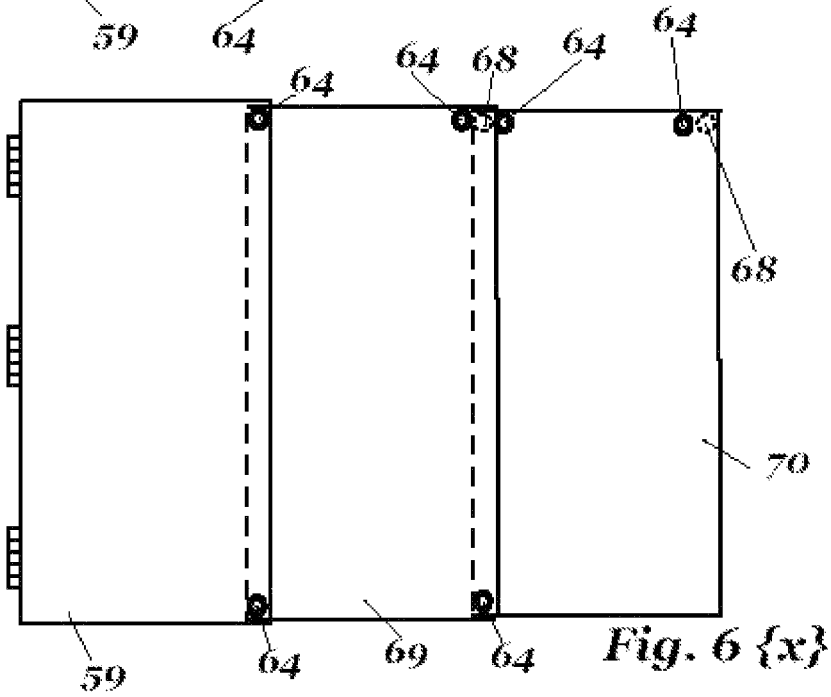
Fig. 6 {x}

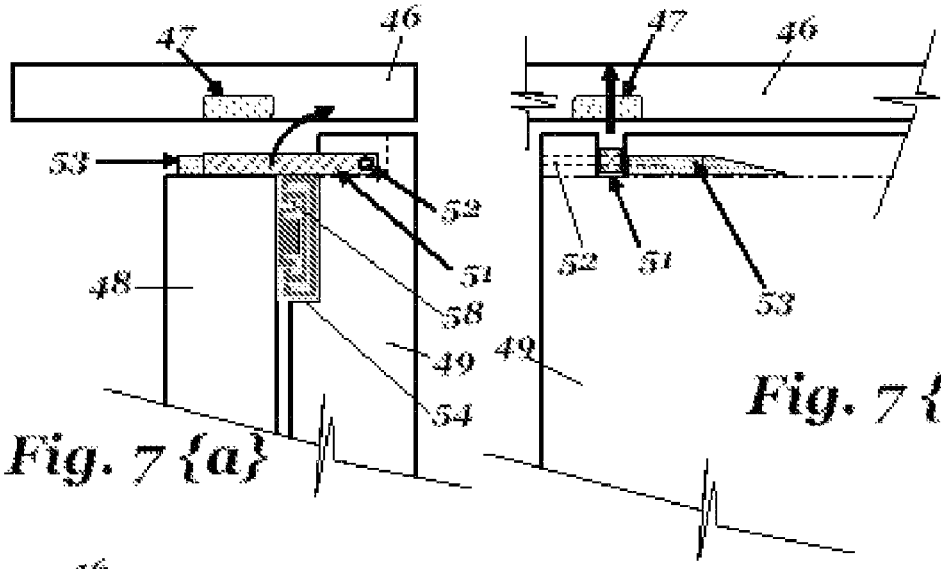
Fig. 7 {a}
Fig. 7 {b}
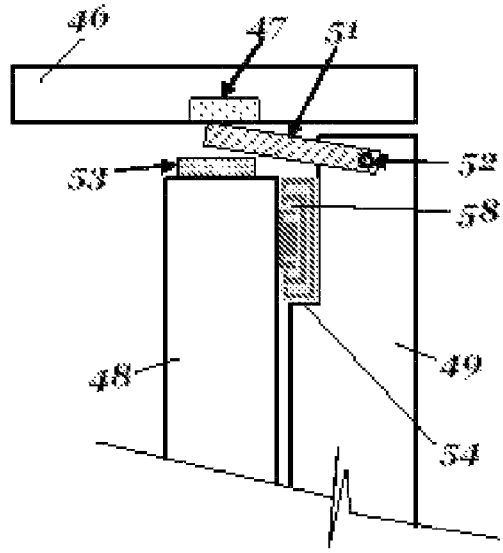
Fig. 7 {c}

Fig. 7 {d}
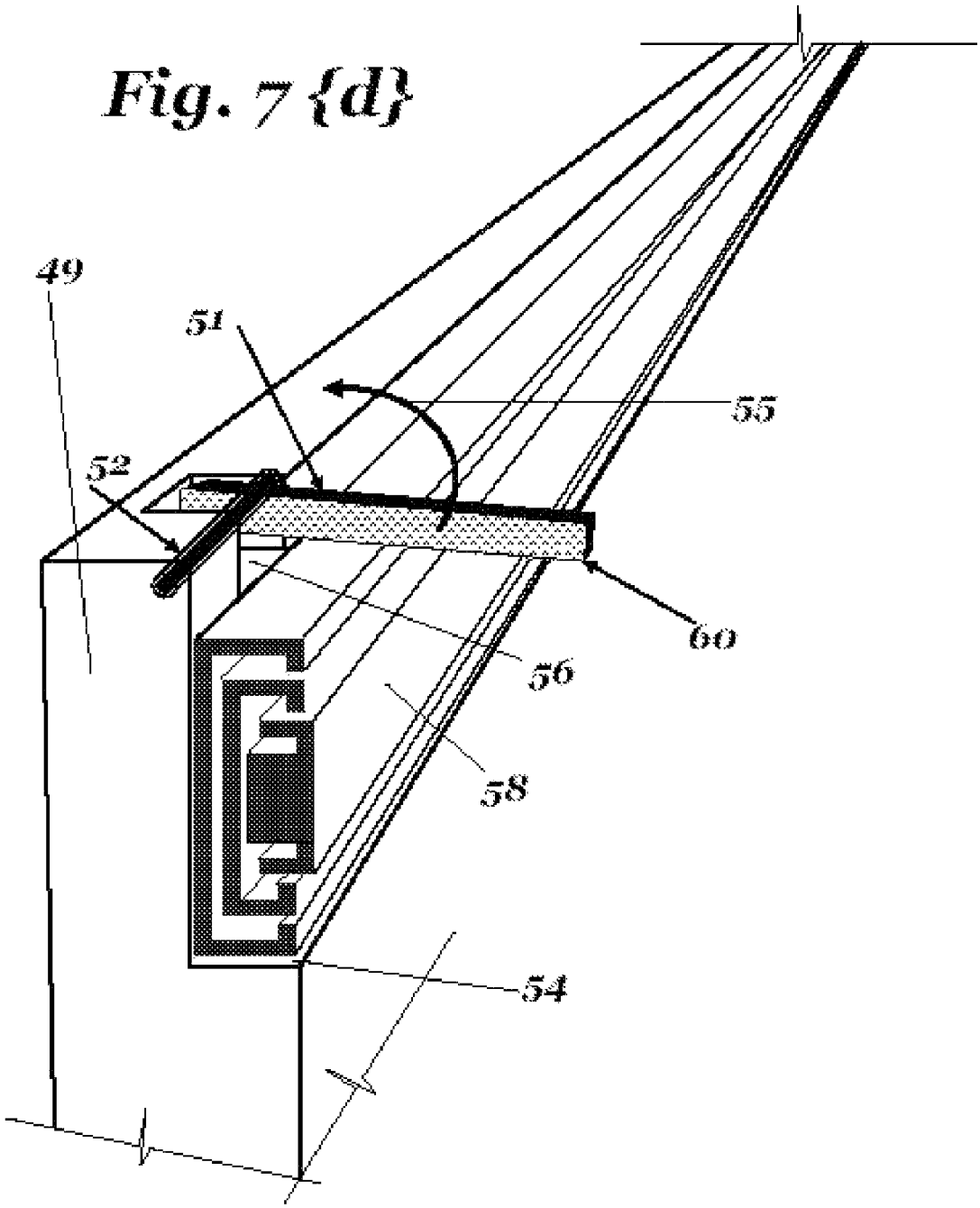

Fig. 7 {e}
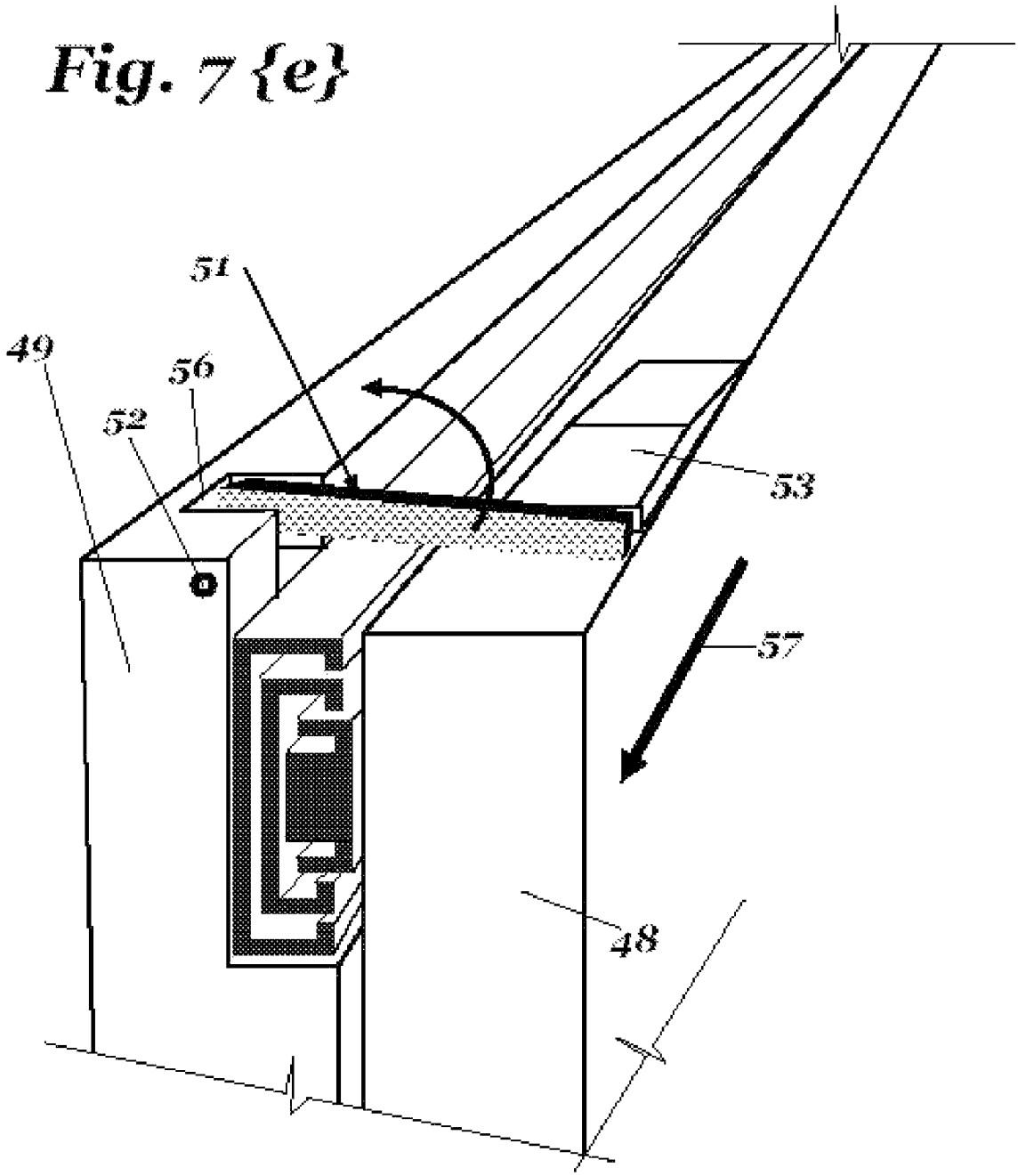

Fig. 7 {f}
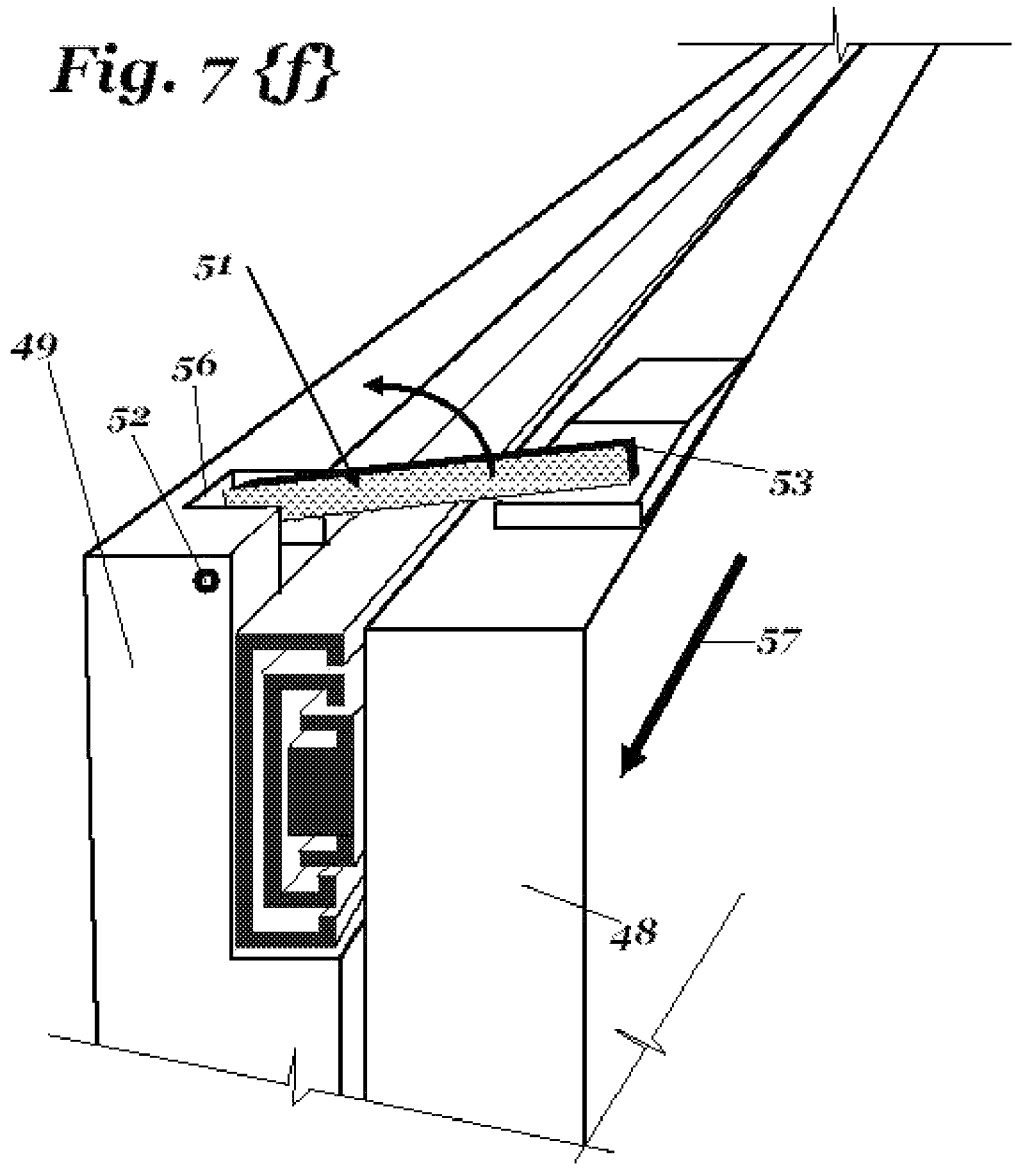

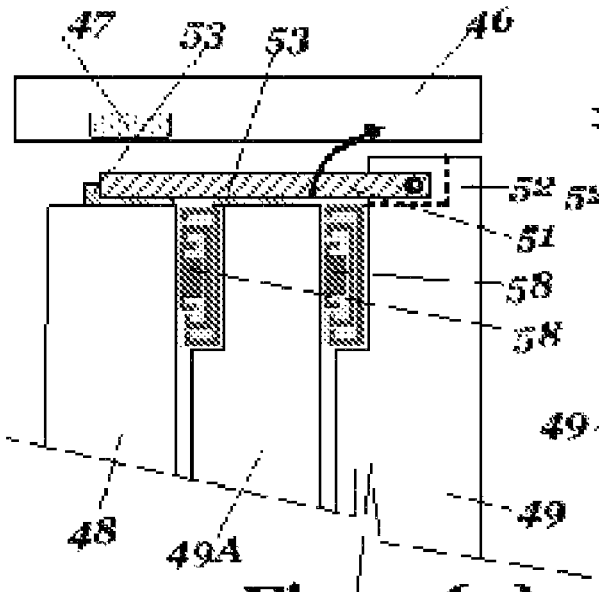
Fig. 7 {g}
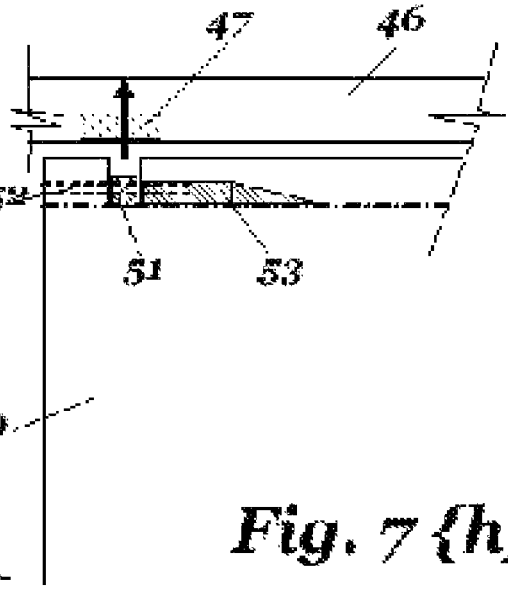
Fig. 7 {h}
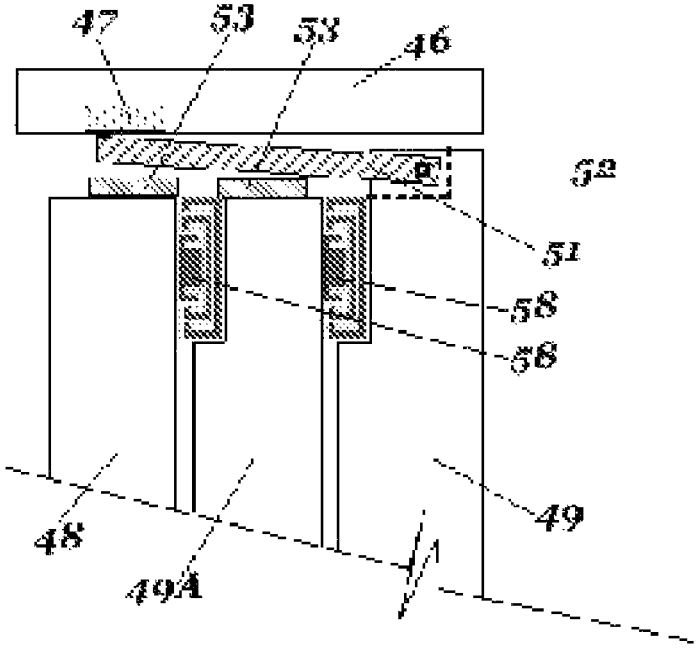
Fig. 7 {i}

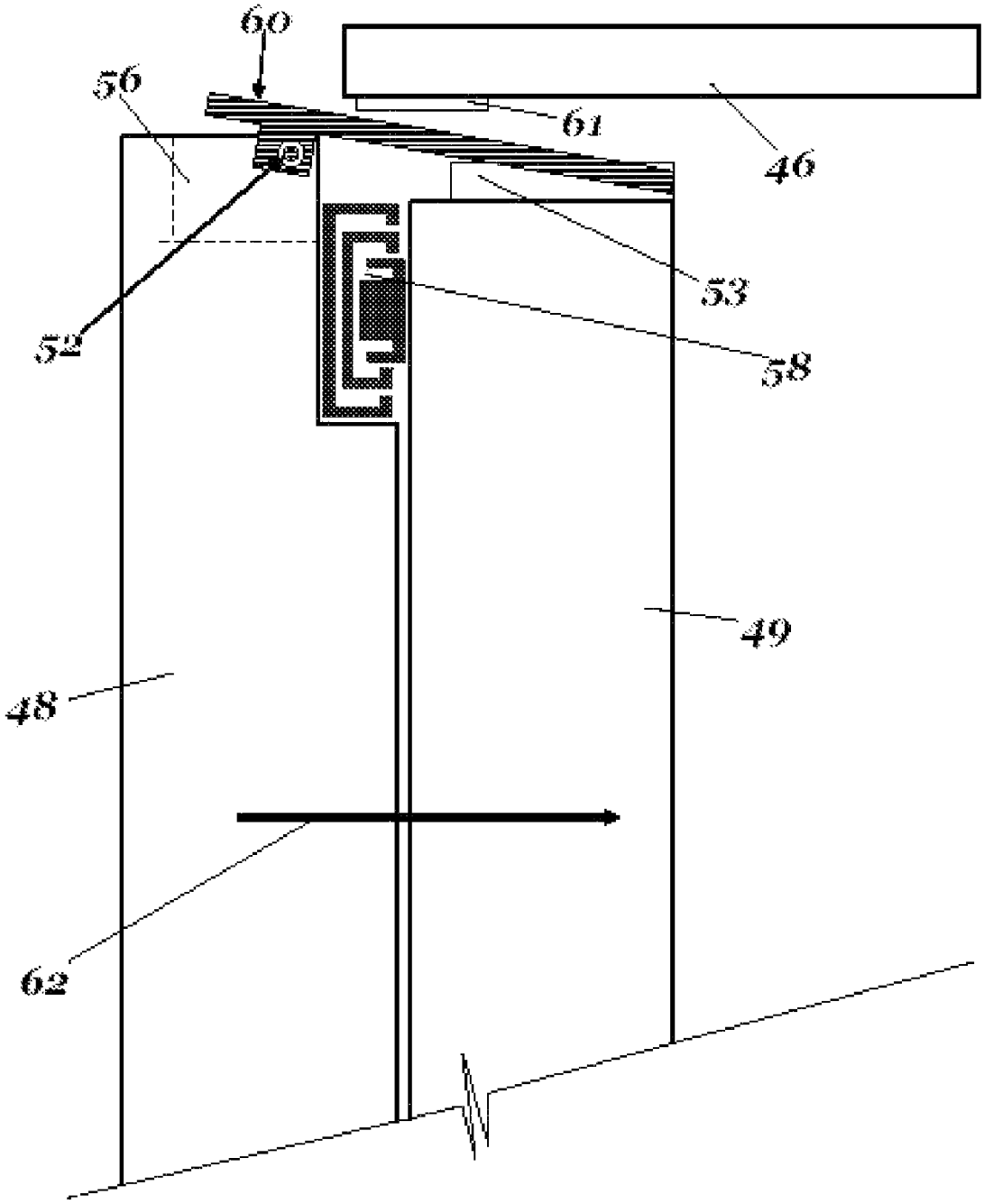
Fig. 7 {j}

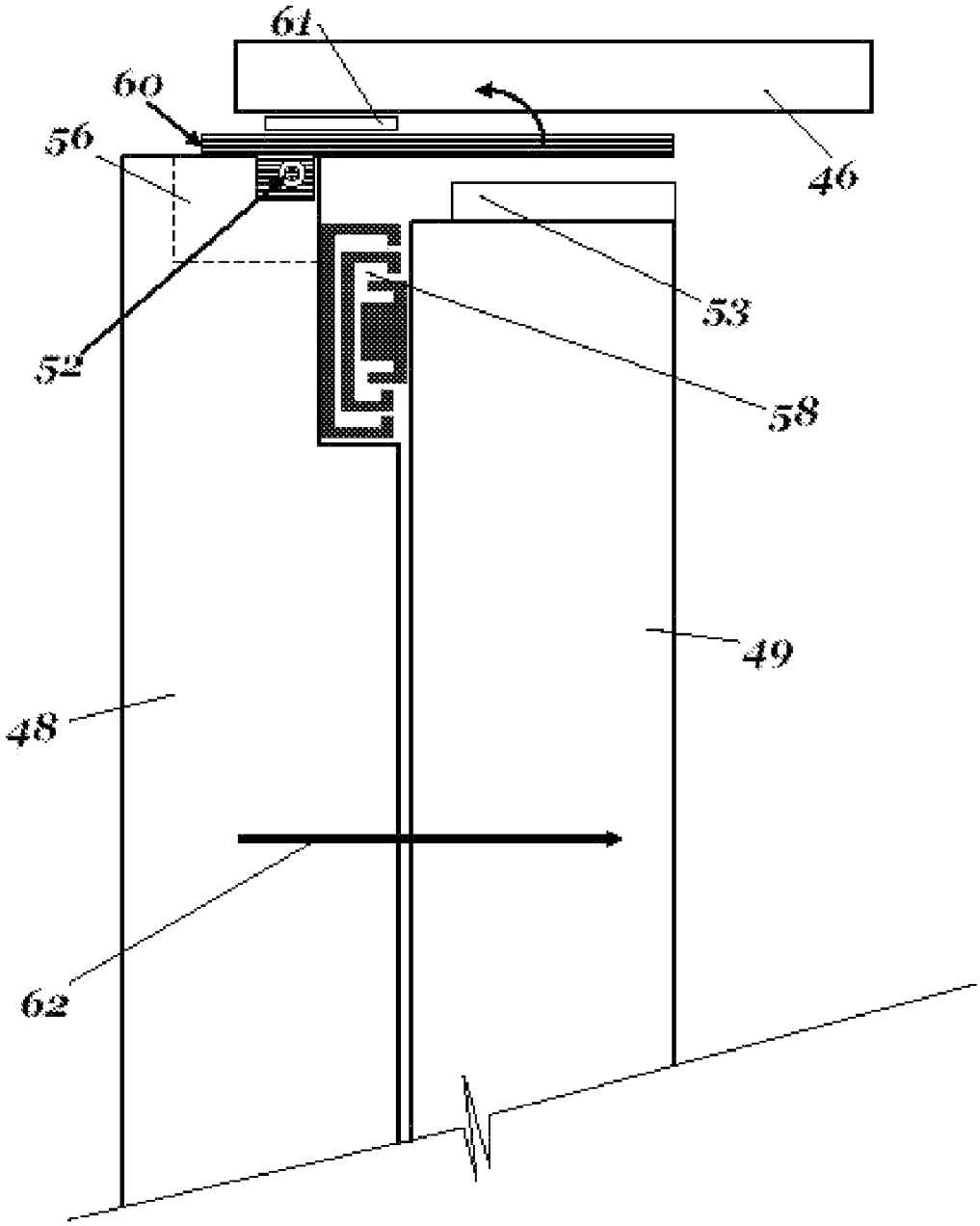
Fig. 7 {k}

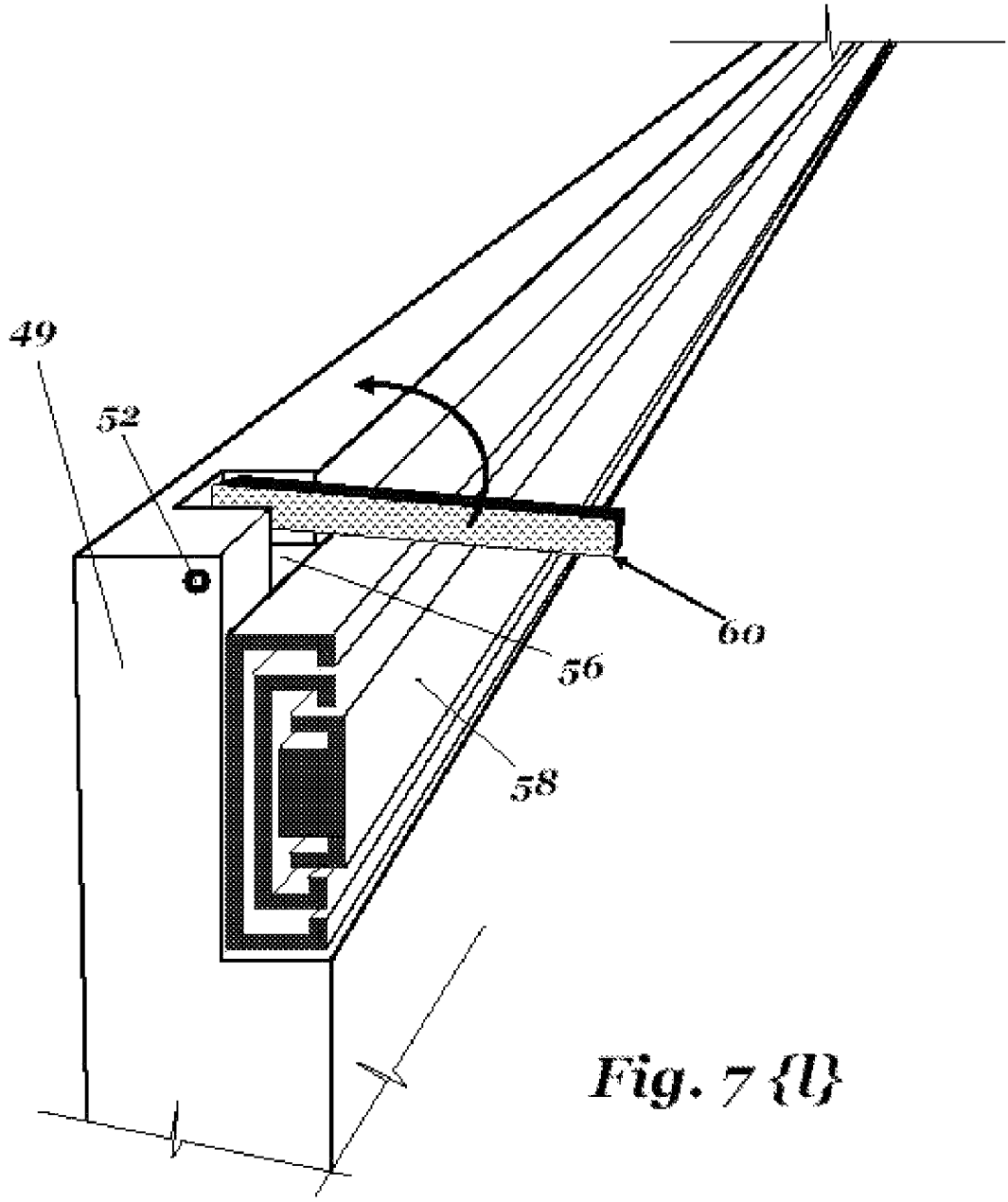
Fig. 7 {l}

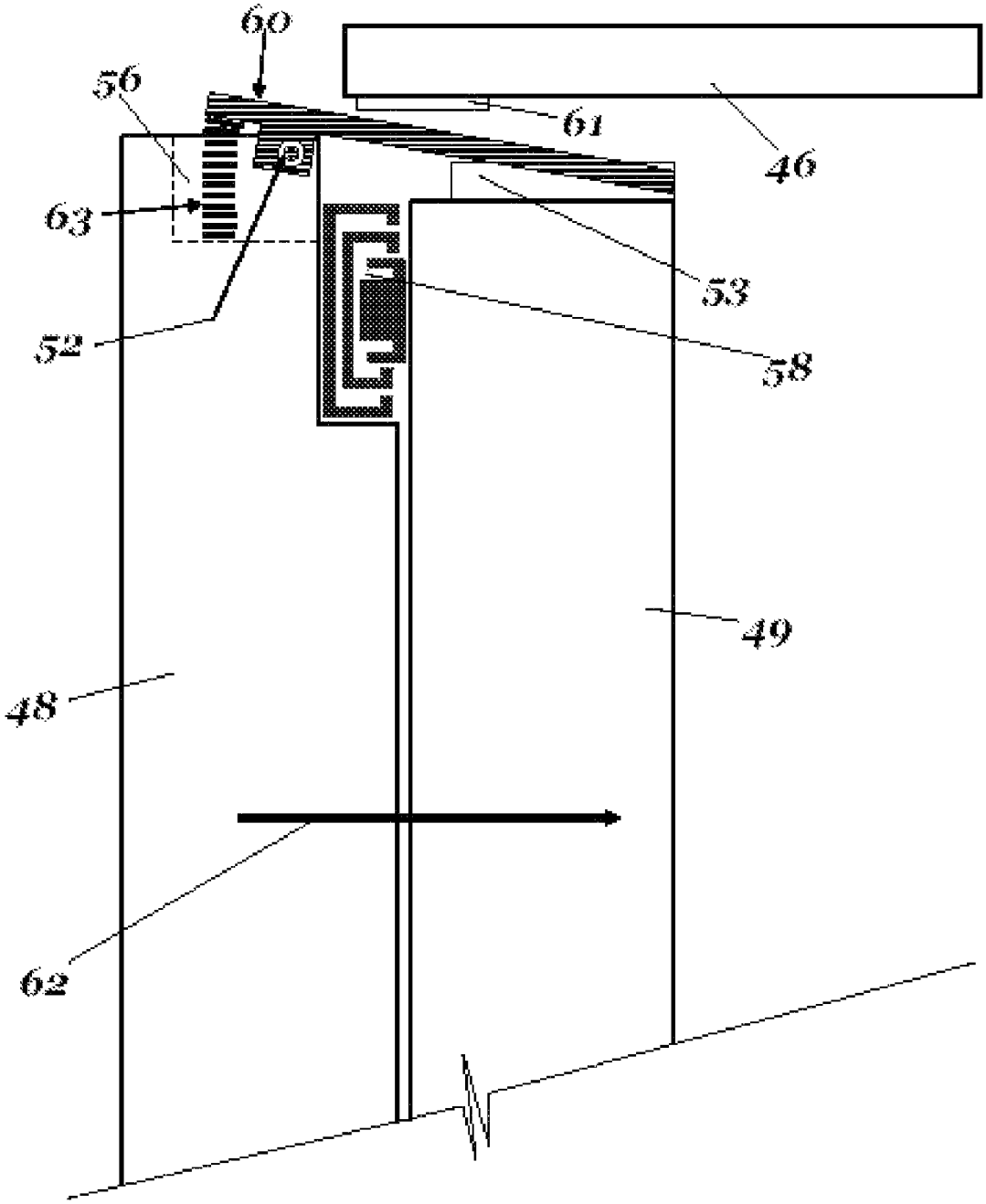
Fig. 7 {m}

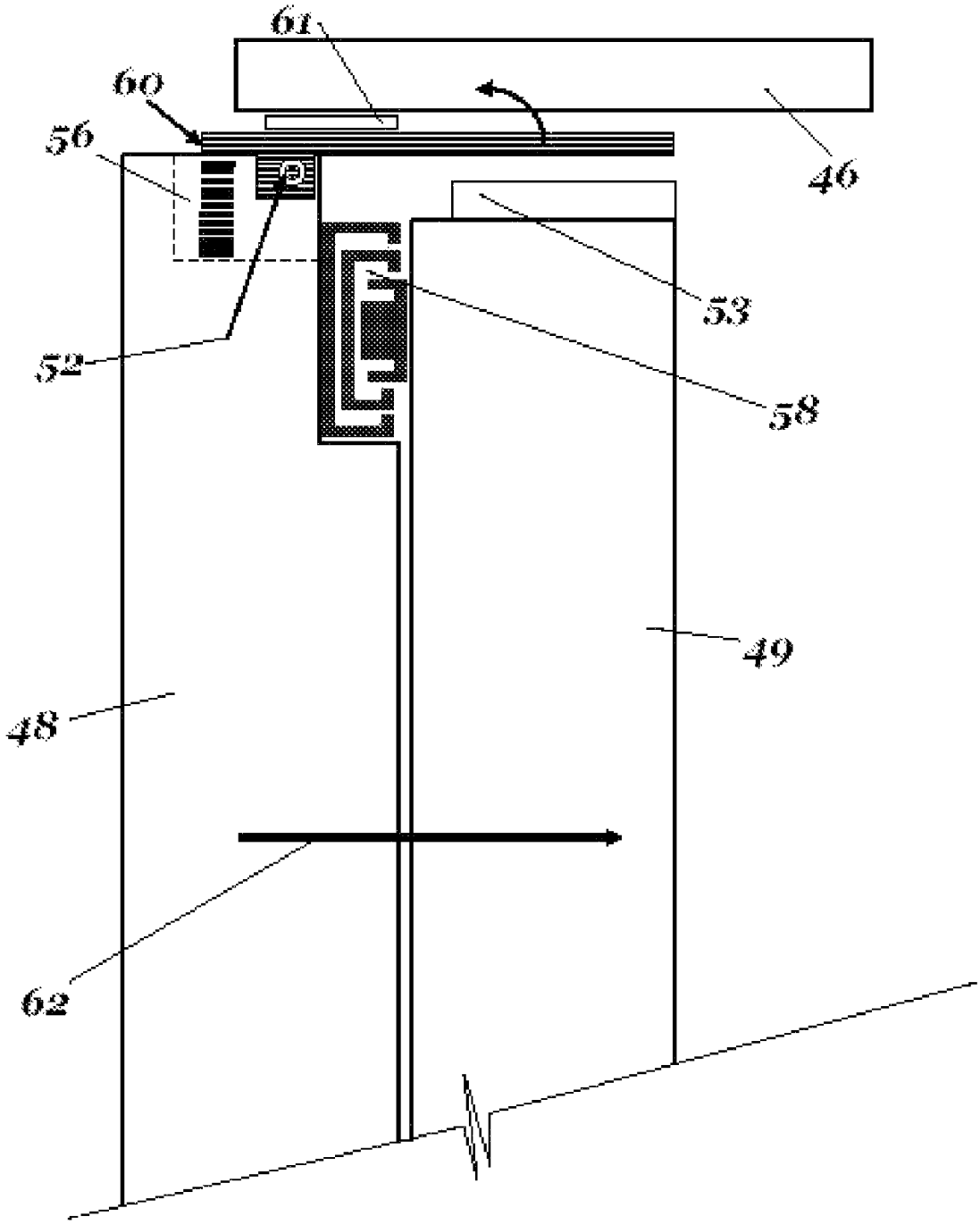
Fig. 7 {n}

COMBINATION-ACTION SLIDE AND HINGE SWINGING DOOR

RELATED APPLICATIONS

This application is related to U.S. Provisional Patent Application Ser. No. 60/739.807, filed Nov. 28, 2005 entitled COMBINATION-ACTION SLIDE AND HINGE SWINGING DOOR.

TECHNICAL FIELD

This invention relates to door assemblies and, in particular, to door assemblies in which the operation is a combination function of first a sliding panel {or panels} unit that slides part way open and then a second hinged swinging panel {or panels} swing fully open a minimum of 180 degrees for full 100% doorway access.

BACKGROUND OF THE INVENTION

There are many different types of residential building, commercial building, and other door applications in need of doors that open and close. Doors most often being used are hinged doors, sliding doors, bi-fold doors, folding doors, and pocket doors. These doors usually have advantages and disadvantages depending on the doorway size and door locations and applications. Often the selection of the door for a specific application is a compromise resulting in disadvantages in its use for said application. As a result, the available ideal door for a specific application is often an unattainable goal.

Single hinged doors traditionally require swing room approximately equal to the width of the individual door and then requires the same amount of wall space if the door is to be sometimes left in the open position and out of the way on one side of the doorway. In the case of a double hinged door, the same amount of swing room and wall space is required on both sides of the doorway because two doors are used one opening from the center of the doorway to the left and one opening from the center of the doorway to the right. In addition, the wall space used with the door left in the open position often creates access problems for light switches and receptacles, plumbing fixtures, and restricts the wall area for furniture use. Also the wider the door the greater the tendency for the door to sag over time due to the weight of the door protruding out so far from the vertical hinge side, often the only means of support. Extremely wide swing doors are often not used for wide door openings such as room dividers because of the impractical large swing radius area and the wall space consumed when the door is left open.

Further, single hinged doors are commonly wider if the doorway is used frequently by individuals confined to wheelchairs. Commercial building codes often mandate wider doors for this reason. However, wider doors create a environment whereby the wheelchair user can pass through the doorway easier but opening and closing the door is more difficult. A wider door with a wider swing radius requires a wheelchair user to pull up to the closed door close enough to grasp the door handle, and then because of the wider door width, he or she must back the wheelchair while pulling the door open and must keep the wheelchair out of the swing radius area as the door opens. Once the door is open, they must move forward again and pull the wide door closed. A similar procedure must be followed in the opposite direction except the door is pushed open and then when closing the door the wheelchair must be kept out of the swing area. This is inconvenient and requires a coordination level that many persons in wheelchairs lack due to their physical, mental or age conditions. Also, hinged doors made of wood often experience material expansion during periods of high humidity resulting in doors that stick or fail to close completely.

The traditional bi-fold door can be hinged on both sides of the inside bi-fold door panel connected to the vertical door frame with the outer panel running inside a non-weight bearing track mounted at the top of the doorway. The track provides alignment during opening and closing of the door panels and when the door is open and closed. However, with traditional interior bi-fold doors, support for all of the door collective panel weight is on the vertical hinges connected to the door jambs. Wide bi-fold doors therefore over time have a tendency to sag. Other problems with this door design is when the door is open, less than 100% full access through the doorway is achieved because the door is usually mounted inside the doorway and the alignment track restricts the door panels from opening beyond 90 degrees leaving the panels protruding into the room inconveniently in the way. Another problem often experienced is with humidity fluctuations and other causes, the panels don't always meet together at ideal travel distances resulting in the panels leaving gaps between the door panels or not leaving enough space between the door panels so the doors have a tendency to pop open and not remain securely closed. The doors are a compromise also regarding sound pass through due to larger gaps running vertically along the door jambs and horizontally running along the door top and bottom. Bi-fold doors inherently due to the design traditionally tend to run sloppy and this condition usually increases as the doors age.

Sliding doors also have drawbacks. As in the case of most slide-by sliding doors, only ½ of the doorway is accessible with the door open making limited access less than desirable. If the door design allows for sliding all the way open, it usually runs along the outside wall and therefore blocks a corresponding large amount of wall space usually needed for furniture placement and/or blocks electrical switches and receptacles. Large wide sliding doors are usually heavy to operate.

Pocket doors also have limitations. Pocket doors built into the wall construction require inside wall space and therefore eliminates that section of wall for wiring, electrical switches and receptacles and plumbing use. It is also difficult and expensive to install as a retrofit in existing walls. Usually the latch or handle is built into the edge of the door and is flush with the edge of the door making it difficult to grasp the small latch to begin pulling the pocket door out of its wall socket. Pocket doors are also prone to coming off the hanging track. Wider pocket doors experience these problems and difficulties even more.

Folding doors also have limitations. Folding doors are usually not available with standard acceptable door styles that match existing conventional doors allowing users to remain with a selected architectural style within the room or building. Folding doors are usually fabric or narrow hard panels and fold together onto themselves. The main disadvantages is that the door when folded still blocks a portion of the available doorway and has a tendency to "pop open" or at least not remain solidly open or closed. They are often difficult to open and closed especially for handicapped people or children.

It is the purpose of this invention to provide alternate construction doors that address the problems and shortcomings of conventional doors. Specifically, to reduce the swing room of hinged doors especially wide doors so that it is practical to use much wider doors and to use wider doors in restrictive areas whereby it would not be possible with conventional doors and to use a wide door that would open fully in one direction only, either to the right side or to the left side. Further, the new invention door provides for full support regardless as to the wide door width. In addition, this invention will allow doors to be installed where it is desirable to leave them open without blocking a large amount of wall space. Furthermore, its purpose is to have doors of conventional architectural design ultra-wide so that would be practical to use them as combination doors and room dividers up to 18 feet or more. In addition, it is the purpose of this invention to result in doors that are easier for wheelchair users to maneuver through and to solve other problems associated with convention doors such as doors sticking in door frames from wood swelling due to high humidity, sagging doors, and full 100% unrestrictive door opening access especially in wider than normal doors.

SUMMARY OF THE INVENTION

By employing the present invention, the prior art drawbacks are overcome therefore providing a door construction that works in many applications where prior art doors would not be suitable or could be and often are considered compromises.

The new invention is a door panel assembly consisting of two or more individual door panel units connected together that function with a combination slide or multi-slide and swing action.

A comparison example for a normal single door width {usually 24" to 42" wide"} would be a 36" wide door. A conventional 36" hinged door would be one solid door unit that would swing on a 36" radius and if left open, would require 36" of wall space to remain out of the way. By comparison, the new invention door for the same 36" doorway could consist of two door panel units each approximately 18" wide or three door panel units each approximately 12" wide with swing radii and wall space requirements of only 18" and 12" respectively.

The new invention two panel unit would function with dual action. To open the door from the closed position the first action would comprise of one panel unit {sliding panel unit} sliding behind the other panel unit {hinged panel unit}. The second action would comprise of both panel units automatically locking together and in the locked together condition, swinging open 180 degrees on an 18" swing radius out of the doorway and require 18" of wall space on one side of the door if left open. To close the door from the opened position, the dual action would be reversed. By comparison, the new invention door for the same 36" doorway could consist of three panel units each approximately 12" wide. The new invention three panel unit would function with multi-action. To open the door from the closed position the first action would comprise of one door unit {end sliding door unit} sliding behind another sliding door unit {center sliding door unit}. The second action would comprise of both sliding door units sliding together behind the hinged door unit. The third action would comprise of after automatically locking together {all three door units} and in the locked together condition, swinging open 180 degrees on a 12" radius out of the doorway and require only 12" of wall space on one side of the door if left open. To close the door from the opened position, the multi-action would be reversed.

A wider than 42" conventional single door width is not practical as the swing radius would be too great and the amount of wall space would be excessive for most applications and the door would have a tendency to sag under the weight with only the vertical hinges for support. Therefore, single doors are not normally wider than 42". However, the new invention door now makes it practical for wider than 42" single doors. For example, a doorway that is 60" wide could now be available as a two panel unit model with each door panel unit 30" or a three panel unit model with each door panel unit 20" wide.

A new invention door that is 60" wide with two panel units each 30" wide would have a swing radius of 30" and require 30" of wall space on one side of the door, either side of the doorway, if left open, well within the acceptable width of conventional doors. The function would be the same as described above for a two door panel unit for a new invention door width 36" door.

A new invention door that is 60" wide with three panels each 20" wide would have a swing radius of 20" and require 20" of wall space on one side of the door if the door was left open, well within the acceptable width and in fact smaller than that of most conventional doors. The function would be the same as described above for a three door panel unit for a new invention door width 36" door.

Conventional double hinged doors are commonly used for wider doorways. A conventional double hinged door is basically comprised of two single type conventional hinged doors, one that swings open from the center of the doorway to the left and one that swings open from the center of the doorway to the right leaving a double width doorway unobstructed for open use.

However this common type of door has limitations similar to conventional single doors relative to the swing radius and wall space required if the door is to be left open. For example, a 42" conventional single door is considered the practical maximum width and for most residential applications 36" is considered the practical maximum. Therefore the double door maximum practical width is 84" and 72" respectively. However, a double door requires room for a 42" swing radius and wall space of 42" if the doors are to remain open some of the time on both sides of the doorway in effect, doubling the wall space and swing area corresponding to the double width of the doorway opening.

The new invention door compared to a conventional double hinged door has significant advantages. First in comparison to the conventional double hinged door with a maximum practical width of 84", the new invention door can be a three panel unit door or four panel unit or a six panel unit door or more than six or a combination of uneven number of panels. Therefore a new invention three panel unit door could have three panel units connected with the before mentioned slide and swing multi-action hinged to swing open to the left or swing open to the right instead of the conventional door requirement of having to swing open on both sides. In effect, an 84" door opening could contain a new invention three panel unit door that could have a single swing radius of 28" and require only 28" of wall space on only one side of the doorway, either side.

Compounding on this, using the single conventional maximum practical door width of 42" would allow for a new invention door to be 126" wide with a single swing radius of 42" and single wall space required of 42" one side of the doorway, either side. Further remaining with the 42" maximum practical swing radius, the new invention door could be made to span a 126" (10½ foot) doorway opening and open with a maximum practical swing radius of 42" and would have the added advantage of opening on one side only . . . either side.

Therefore a new invention four panel unit door would have two panel units connected with the before mentioned slide and swing dual action hinged to swing open to the left and two panel units connected with the slide and swing dual action hinged to swing open to the right. As an example of the advantages would be a new invention double door with an open width of 84" that would have a swing radius and wall space requirement of 21" on the left side of the double door opening and 21" on the right side of the double door opening compared to a conventional 42" hinged door that would require a full 42" on each side of the door. Further, the new invention door would have a corresponding larger door opening practical maximum opening of 168" (14 foot door width)

In addition the new invention door could be made as five panel unit door with two panel units opening to one side of the doorway and 3 panel units opening to the other side of the doorway. An example would be a doorway that is 180" (15 feet} wide. One side, either side, could be made with a two panel unit, with each panel unit 36" wide with a swing radius of 36". The other side, could be made with a three panel unit, with each panel unit 36" also with a swing radius of 36". There is no practical conventional hinged door for comparison for a door as wide as this example. Alternative options would be doors of the bi-fold, folding or sliding style but with the inherent disadvantages. Another example would be a more common narrower door of 80" wide. A conventional double door would have a swing radius of 40" on both sides of the door. The new invention door could be made with two panel units on one side each 16" wide and three panel units on the other side each 16" wide. This new invention door would span the same 80" door opening but with a much reduced swing radius of only 16" on both sides instead of 40". This door could be used in a smaller space than the conventional 80" double door.

Also a new invention door six or more panel units could be made with three or more connected panel units on each side with the multi-function described above consisting of the two sliding actions (multi-slide) and then a swing action on both sides of the doorway. An example would be three 36" panel units on one side of the doorway and three 36" panel units on the other side of the doorway. This example would allow for a very wide 18 foot doorway with only 36" of swing room and wall space when left open required on both sides of the doorway. Again, there is no practical conventional hinged door for comparison for a door as wide as this example. Alternative options would be doors of the bi-fold, folding or sliding style but with the inherent disadvantages.

THE DRAWINGS

For a fuller understanding of the nature and objects of the present invention, reference should be made to the following drawings, in which:

FIG. 1 {a} is a front elevation view showing a two panel unit door fully closed. {b} a front elevation view showing a two panel unit door with the sliding panel unit partially open. {c} a front elevation view showing two panel unit door with the sliding panel unit completely open and behind the hinged panel unit. {d} a front elevation view showing a two panel unit door with the two panels locked together and rotated fully open 180 degrees.

FIG. 2 . . . {a} is a front elevation view showing a three panel unit door fully closed. {b} is a front elevation view showing a three panel unit door with the end sliding panel unit partially open. {c} is a front elevation view showing a three panel unit door with the end panel unit fully open and locked behind the center sliding panel unit which is partially open {d} is a front elevation view showing a three panel unit door with the end sliding panel unit and the center sliding panel unit completely open and behind the hinged panel unit. {e} is a front elevation view showing a three panel unit door with the three panels locked together and rotated fully open 180 degrees.

FIG. 3 . . . {a} is a front elevation view showing a four panel unit door fully closed. {b} is a front elevation view showing a four panel unit door with both the sliding panel units partially open. {c} is a front elevation view showing a four panel unit door with both the sliding panel units fully open and fully behind both the hinged panel units. {d} is a front elevation view showing a four panel unit door with both the sliding panel units locked together with the sliding panel units and rotated fully open 180 degrees on both sides of the doorway.

FIG. 4 . . . {a} is a front elevation view showing a five panel unit door full closed. {b} is a front elevation view showing a five panel unit door with the sliding panel unit on the side with 2 panel units partially open and with the end sliding panel unit on the side with 3 panel units partially open. {c} is a front elevation view showing a five panel unit door with the sliding panel unit on the side with 2 panel units fully open and behind the hinged panel unit and the end sliding panel on the side with 3 panel units fully open and behind the center sliding panel unit {d} is a front elevation view showing a five panel unit door with the siding panel unit on the two panel unit door assembly fully behind the hinged panel unit and the end panel unit on the three door panel assembly fully behind the center panel unit and with both sliding panel units together partially behind the hinged panel unit. {e} is a front elevation view showing a five panel unit door with all three of the sliding panel units together and fully behind the two hinged panel units. {f} is a front elevation of a five panel unit door assembly with all sliding panel units behind the two hinged panel units and all panel units together fully swing rotated open 180 degrees on both sides of the doorway.

FIG. 5 . . . {a} is a front elevation view showing a six panel unit door full closed. {b} is a front elevation view showing a six panel unit door with the two end sliding panel units partially open {c} is a front elevation view showing a six panel unit door with the end sliding panel units fully open and behind the two center sliding panel units {d} is a front elevation view showing a six panel unit door with the end sliding panel units fully behind the center panel units and together partially behind the hinged panel units. {e} is a front elevation view showing a six panel unit door with all four of the sliding panel units together and behind the two hinged panel units. {f} is a front elevation view showing a six panel unit door with all four sliding panel units locked together with the two hinges panel units and all panel units rotated fully open 180 degrees on both sides of the doorway.

FIG. 6 . . . {a} is a front elevation view of the door header assembly for a four panel unit door without cutaway views. {b} is a front elevation view of the door header assembly for a three panel unit door without cutaway views. {c} is a front elevation view of the door header assembly for a two panel unit door without cutaway views. {d} is a plan top cutaway view of a four panel unit door assembly {e} is a plan top cutaway view of a three panel unit door assembly {f} is a plan top cutaway view of a two panel unit door assembly {g} is an end view of a cut off two panel unit door assembly showing the top area weight support and alignment component assembly. {h} is a elevation section view showing the roller assembly and support track for a two panel unit or three panel unit door assembly {i} is an end view of a cut off three panel unit door assembly showing the top area weight support and alignment component assembly {j} is a elevation view of a two panel unit door assembly showing the location of the roller assembly {k} is a elevation view of a three panel unit door assembly showing the location of the two roller assemblies {l} is a elevation view of a four panel unit door assembly showing the locations of the two roller assemblies {m} is a elevation view of a five panel unit door assembly showing the locations of the three roller assemblies {n} is a elevation view of a six panel unit door assembly showing the locations of the four roller assemblies {o} is a perspective view showing the roller support assembly {p} is a perspective view showing the solid one piece support component as an alternate for the roller support assembly {q} is an end view of a two panel door assembly roller door panel unit connection and roller support assembly as an alternate for the use of a slide mechanism to connect and control door action {r} is an end view of a three panel door assembly roller door panel unit connection and roller support assembly as an alternate for the use of a slide mechanism to connect and control door action {t} is a perspective view of the integral mating T-shaped cutout roller slot used with roller assemblies within the alternate mechanism for the slide mechanism {i} is an exploded perspective view of the roller assembly {u} is a perspective view of the integral mating rabbet cutout with a integral roller retaining vertical wall roller slot used with roller assemblies within the alternate mechanism for the slide mechanism {v} is a perspective view of the integral rabbet cutout roller slot combined with a separate attached roller retaining vertical wall used with roller assemblies within the alternate mechanism for the slide mechanism {w} is an elevated view of a two panel unit door assembly to show the locations of the support and alignment rollers for an alternate support mechanism in place of slide mechanism use {x} is an elevated view of a three panel unit door assembly to show the locations of the support and alignment rollers for an alternate support mechanism in place of slide mechanism use FIG. 7 . . . {a} is an end cut-a-way top area view of a two panel unit door assembly showing the panel unit connecting slide mechanism and the magnetic/gravity actuating lock bar mechanism used to lock slide panel units to the hinged panel unit during the swing rotation action. The view is shown with the lock bar in the lower or locked position. {b} is a front elevation cut-a-way top view of the same. {c} is the same view as FIG. 7 {a} except with the lock bar in the upper or unlocked position. {d} is a perspective view showing the hinged panel unit only with the connecting slide mechanism and the magnetic/gravity actuating lock bar and pivot pin assembly and direction of rotation to disengage the hinged panel unit from the sliding panel unit. {e} is a perspective view showing the hinged panel unit and the sliding panel unit and relationship of the components included the magnetic/gravity actuating panel unit locking mechanism in the locked position with the pivot lock bar in the lower position. {f} . . . is a perspective view showing the hinged panel unit and the sliding panel unit and relationship of the components included in the magnetic/gravity actuating panel unit locking mechanism in the unlocked position with the pivot lock bar in the raised position. {g} is an end cut-a-way view of a door's three panel units with the relationship of the connecting slide mechanism and the magnetic/gravity actuating lock bar mechanism used to lock the end sliding panel unit and the center sliding panel unit to prohibit the dual sliding action function during the swing action function. View shown with the lock bar in the lower or locked position. {h} is a front elevation cut-a-way view of the same. {i} is the same view as FIG. 7 {a} except with the lock bar in the upper or unlocked position. {j} is an end top view of a two panel unit door assembly showing a gravity lock bar mechanism in the locked lower position as an alternate to the magnetic/gravity lock bar mechanism. {k} is an end top view of a two panel unit door assembly showing a gravity lock bar mechanism in the unlocked upper position as an alternate to the magnetic/gravity lock bar mechanism . . . {l} is a perspective view of the top of the hinged panel unit showing the gravity lock bar alternate described above. {m} is an end top view of a two panel unit door assembly showing a spring force lock bar mechanism in the locked lower position as an alternate to the magnetic/gravity lock bar mechanism and the gravity lock bar mechanism. {n} is an end top view of a two panel unit door assembly showing a spring force lock bar mechanism in the unlocked upper position as an alternate to the magnetic/gravity lock bar mechanism and the gravity lock bar mechanism.

DETAILED DESCRIPTION

By referring to FIGS. 1-7, along with the following detailed discussion, the construction and operation of several alternate embodiments for combination sliding and swinging door assemblies of the present invention can best be understood. Although this detailed disclosure provides a thorough discussion of the preferred embodiments of the present invention, further alternate constructions for implementing the present invention can be made without deviating from the scope of this invention. Consequently, it is to be understood that the following disclosure is provided for exemplary purposes only, and is not intended as a limitation of the present invention.

In FIGS. 1-{a} through {d}, a dual action two panel unit door assembly is depicted in the fully closed position {a} though the sliding action of the sliding panel unit 1 to behind the hinged panel unit 2 {b} {c} and then with the sliding panel unit 1 and the hinged panel unit 2 locked together through the hinged swinging 180 degree action to the right side of the doorway to the door assembly's fully open position {d}. It should be noted that the dual action described above could be reversed so that the sliding panel unit 1 and the hinged panel unit 2 slide and swing in such a manner that the door swings open to the left side of the doorway. Typical doorways include different doorway widths. As discussed above, one of the principal difficulties encountered with doorways especially wider doorways, is that there may be inadequate or marginally adequate space or room for the conventional hinged door to swing because usually the width of the conventional door is approximately the same as the swing radius. In confined areas such as a narrow hallway or small room this can and often is problematic as the conventional door often swings into space occupied or could be occupied by persons, furniture, wall electrical switches and receptacles or other doorways. A wider doorway is usually desirable but not practical therefore a compromise is created by using a narrower door. The new invention, if a two panel unit door assembly is employed, deduces the swing radius to approximately 50% of the conventional door and therefore makes it practical for a wider doorway to be installed in the narrow space. This is especially advantageous for doorways that must or should have wheelchair access. Further, this new invention allows for an even wider door than is needed due to its inherent design. For example, instead of a conventional 36" wheelchair access door width, the new invention makes it practical for a two panel unit dual action door to be 72" wide with the same 36" swing radius as a conventional 36" width door.

In order to achieve this result, sliding panel unit 1 is connected to hinged panel unit 2 with a connecting slide mechanism {DESCRIBED IN FIG. 7 number 58}. To open the door, one would move sliding panel unit 1 horizontally to a position behind hinged panel unit 2 {b}. As sliding panel unit 1 moves behind hinged panel unit 2, it disengages from the support track {DESCRIBED IN FIG. 6 item number 39} and out from behind the retainer face plate 5. Once sliding panel unit 1 is fully behind hinged panel unit 2 {c}, hinged panel unit 2 along with connected sliding panel unit 1 are free to swing rotate 180 degrees to the door assembly's fully open position {d}. Further, at the beginning of the swing rotation cycle {d}, sliding panel unit 1 and sliding panel unit 2 are automatically locked together by the magnetic/gravity lock bar mechanism {DESCRIBED IN FIG. 7}. In addition, when the door action is reversed in the process of closing the door at the time of swing rotation completion {c} the magnetic/gravity lock bar mechanism automatically unlocks the sliding panel unit 1 from hinged panel unit 2 freeing sliding panel unit 1 to slide horizontally closed to the dual action door assembly's fully closed position {a}.

In FIGS. 2-{a} through {e}, a multi-action three panel unit door assembly is depicted in the fully closed position {a} though the sliding action of the end sliding panel unit 6 to behind the center sliding panel unit 7 {b} and then with the end sliding panel unit 6 and the center sliding panel unit 7 together through the sliding action to behind the hinged panel unit 8 {c} {d}. and then with the end sliding panel unit 6 and the center sliding panel unit 7 and the hinged panel unit 8 locked together through the hinged swinging 180 degree action to the right side of the doorway to the door assembly's fully open position {e}. It should be noted that the dual action described above could be reversed so that all three panel units could slide and swing in such a manner that the door swings open to the left side of the doorway. . Typical doorways include different doorway widths.

One of the principal difficulties encountered with wide doorways is that there may be inadequate or marginally adequate space or room for the conventional double hinged door to swing open on both sides of the doorway. Doorways wider than 42" and in many cases wider than 36", are usually too wide for a single panel conventional door because of the swing radius and wall space required if the door is to remain open some or all of the time. Usually a double door is used whereby one door opens to the right and one door opens to the left. The new invention, if a three panel unit door assembly is employed, reduces the swing radius to approximately 33% of the conventional door and opens on one side of the doorway only, either side, and therefore makes it practical for a wider door to be installed in a doorway up to nine foot wide or wider. For example, a new invention door could have a nine foot wide doorway with a door swing radius of only 36" on only one side of the doorway, either side. In order to achieve this result, the end sliding panel unit 6 is connected to the center sliding panel unit 7 with a connecting slide mechanism {DESCRIBED IN FIG. 7}. In addition, the center panel unit 7 is connected to the hinged panel unit 8 with another same connecting slide mechanism {DESCRIBED IN FIG. 7}. To open the door, one would move the end sliding panel unit 6 horizontally to a position behind the center sliding panel unit 7 {b} and then move the end sliding panel unit 6 together with the center sliding panel unit 7 to a position behind hinged panel unit 8 {c} {d}. As the two sliding panel units 6-7 move behind hinged panel unit {d}, the end sliding panel unit disengages from the support track {DESCRIBED IN FIG. 6}{d}{e}. Once both sliding panel units 6-7 are fully behind hinged panel unit 8 {d}, hinged panel unit 8 along with connected sliding panel units 6-7 are free to swing rotate out from behind the retainer face plate 11 and on to the door assembly's fully 180 degree open position {e}. Further, at the beginning of the swing rotation cycle {e}, both sliding panel units 6-7 are automatically locked together with hinged panel unit 8 by the magnetic/gravity lock bar mechanism {DESCRIBED IN FIG. 7}. In addition, from the fully open position when the door action is reversed in the process of closing the door at the time of swing rotation completion {d} the magnetic/gravity lock bar mechanism automatically unlocks both of the sliding panel units 6-7 from hinged panel unit 8 freeing the sliding panel units 6-7 to slide closed to the new invention's door fully closed position {a}.

In FIGS. 3-{a} through {d}, a dual action four panel unit door assembly is depicted in the fully closed position {a} though the sliding action of the sliding panel unit 13 to behind the hinged panel unit 12 and sliding panel unit 14 to behind the hinged panel unit 15 {b}{c} and then with the sliding panel unit 13 and the hinged panel unit 12 locked together and with the sliding panel unit 14 and the hinged panel unit 15 locked together through the hinged swinging 180 degree action to the left side and the right side of the doorway to the door assembly's fully open position {d}.

Typical wide doorways include different doorway widths. Usually up to a maximum doorway width of about 84" use dual conventional doors that open from the center of the doorway with one opening to the left and one opening to the right. It is not practical to use wider conventional doors because the swing radius would be too large and it would take up too much wall space when the doors are left open. These problems would be compounded by probable sag because of the large doors weight and lack of support considering the only support would be on the hinged vertical edge of the door. A wider doorway often is desirable but not practical therefore a compromise is created by using a narrower door. The new invention, if a four panel unit door assembly is employed, deduces the swing radius to approximately 50% of the conventional door and therefore makes it practical for a wider doorway to be installed. In order to achieve this result, sliding panel unit 13 is connected to hinged panel unit 12 with a connecting slide mechanism {DESCRIBED IN FIG. 7} and sliding panel unit 14 is connected to hinged panel unit 15 with another connecting slide mechanism. To open the door, one would move sliding panel unit 13 horizontally to a position behind hinged panel unit 12 and move sliding panel unit 14 horizontally to a position behind hinged panel unit 15 {b}. As sliding panel unit 13 moves behind hinged panel unit 12, it disengages from the support track {DESCRIBED IN FIG. 6} and out from behind the left side of retainer face plate 18 and as sliding panel unit 14 moves behind hinged panel unit 15, it disengages from the support track {DESCRIBED IN FIG. 6} and moves out from behind the right side of retainer face plate 18. Once sliding panel unit 13 is fully behind hinged panel unit 12 {c} hinged panel unit 12 along with connected sliding panel unit 13 are free to swing rotate open to the left of the doorway 180 degrees to the door left side assembly's fully open position {d}. And, once sliding panel unit 14 is fully behind hinged panel unit 15 {c} hinged panel unit 14 along with connected sliding panel unit 15 are free to swing rotate open to the right of the doorway180 degrees to the door left side assembly's fully open position {d}. With both the left and right door unit assemblies open 180 degrees out of the doorway, the doorway if fully open with 100% unrestrictive access. Further, at the beginning of the swing rotation cycle {d}, sliding panel unit 13 and hinged panel unit 12 are automatically locked together by the magnetic/gravity lock bar mechanism {DESCRIBED IN FIG. 7}. Sliding panel unit 14 and hinged panel unit 15 are likewise locked together at the beginning of the rotation cycle {c}.

Noted also is that when the door action is reversed in the process of closing the door at the time of swing rotation completion {c} the magnetic/gravity lock bar mechanism {DESCRIBED IN FIG. 7} automatically unlocks the sliding panel unit 13 from hinged panel unit 12 freeing sliding panel unit 13 to slide right and behind retainer face plate 18 {c} {DESCRIBED IN FIG. 6} and engages the left side of the support track {DESCRIBED IN FIG. 6} to the dual action door assembly's left side fully closed position {a}. Also is that when the door action is reversed in the process of closing the door at the time of swing rotation completion {c} the magnetic/gravity lock bar mechanism {DESCRIBED IN FIG. 7} automatically unlocks the sliding panel unit 14 from hinged panel unit 15 freeing sliding panel unit 14 to slide left and behind retainer face plate 18 {c} {DESCRIBED IN FIG. 6} and engages the right side of the support track {DESCRIBED IN FIG. 6} to the dual action door assembly's right side fully closed position {a}.

In FIGS. 4-{a} through {f}, a combination dual and multi-action five panel unit door assembly is depicted in the fully closed position {a} though the sliding action of the sliding panel unit 20 {a} to behind the hinged panel unit 19 {b} {c} and end sliding panel unit 21 {a} to behind center sliding panel 22 {b}{c} and then end sliding panel 21 behind center panel unit 22 {c} together behind panel hinged panel unit 23 {e} and then with the sliding panel unit 20 and the hinged panel unit 19 locked together and with the end sliding panel unit 21 and the center sliding panel unit 22 and the hinged panel unit 23 locked together through the hinged swinging 180 degree action to the left side and the right side of the doorway to the door assembly's fully open position {e} {f}.

Typical wide doorways include different doorway widths. Usually up to a maximum doorway width of about 84" use dual conventional doors that open from the center of the doorway with one opening to the left and one opening to the right. It is not practical to use wider conventional doors because the swing radius would be too large and it would take up too much wall space when the doors are left open. These problems would be compounded by probable sag because of the large doors weight and lack of support considering the only support would be on the hinged vertical edge of the door. . A wider doorway often is desirable but not practical therefore a compromise is created by using a narrower door. The new invention, if a five panel unit door assembly is employed, deduces the swing radius to approximately 50% of the conventional door on one side of the doorway and to approximately 50% or 33% on the other side of the doorway and therefore makes it practical for a wider doorway to be installed. Further, a five panel unit door assemblies offers more flexibility relating to overall door opening width and the use of the available wall space on both sides of the doorway. For example, a wide doorway opening may be desired but due to the wall and floor design construction, may have more room against the wall on one side than on the other to leave a door open and out of the way. With a 5 panel unit door assembly, for a wide doorway of 120", one side of the doorway could contain a two panel unit with each panel 30" and therefore a swing radius of 30" and wall space requirements of 30" on that side of the doorway whereas the other side of the doorway could contain a 3 panel unit with each panel 20" and therefore a swing radius of 20" and wall space requirements of 20" on that side of the doorway. Another example would be a wide doorway that is 120" wide. One option would be to use a four panel unit door assembly with each panel 30" wide with a swing radius and wall space requirement of 30" on both sides of the door and another option would be to use a five panel unit door assembly with each panel 24" wide with a reduced swing radius and wall space requirement of 24" on both sides of the door.

In order to achieve this result, sliding panel unit 20 is connected to hinged panel unit 19 with a connecting slide mechanism {DESCRIBED IN FIG. 7} and end sliding panel unit 21 is connected to center sliding panel unit 22 and center panel 22 is connected to hinged panel unit 23 with another connecting slide mechanism {a}. To open the door, one would move sliding panel unit 20 horizontally to a position behind hinged panel unit 19 {b} and move end sliding panel unit 21 horizontally to a position behind center sliding panel unit 22 {b} and then sliding panel units 21-22 together to a position behind hinged panel unit 23 {c} {d} {e}. As sliding panel unit 20 moves behind hinged panel unit 19, sliding panel unit 20 disengages from the support track {DESCRIBED IN FIG. 6} and then when sliding panel unit 20 connected to and behind hinged panel unit 21 together both sliding panel units along with hinged panel unit 23 are now free to swing rotate out from behind the left side of retainer face plate 26 {e} {f}. Further with end sliding panel unit 21 behind center sliding panel unit 22 together slides horizontally behind hinged panel unit 23, end sliding panel unit 21 disengages from the support track {DESCRIBED IN FIG. 6}{e} and together both sliding panels 21-22 along with hinged panel unit 23 are now free to swing rotate out from behind the right side of retainer face plate 26 {e} {f} to the fully 180 degree open position. With both the left and right door unit assemblies open 180 degrees out of the doorway, the doorway if fully open with 100% unrestrictive access. Further, at the beginning of the swing rotation cycle {e}, sliding panel unit 20 and hinged panel unit 19 are automatically locked together by the magnetic/gravity lock bar mechanism {DESCRIBED IN FIG. 7}. End sliding panel unit 21 and center sliding panel unit 22 and hinged panel unit 23 are likewise locked together at the beginning of the rotation cycle {e} {f}.

Noted also is that when the door action is reversed in the process of closing the door at the time of swing rotation completion {e} the magnetic/gravity lock bar mechanism {DESCRIBED IN FIG. 7} automatically unlocks the sliding panel unit 20 from hinged panel unit 19 freeing sliding panel unit 20 to slide right and behind retainer face plate 26 {c} {DESCRIBED IN FIG. 6} and engages the left side of the support track {DESCRIBED IN FIG. 6} to the dual action door assembly's left side fully closed position {a}. Also is that when the door action is reversed in the process of closing the door at the time of swing rotation completion {c} the magnetic/gravity lock bar mechanism {DESCRIBED IN FIG. 7} automatically unlocks the end sliding panel unit 21 from the center sliding panel unit 22 and from hinged panel unit 23 freeing end sliding panel unit 21 and center sliding unit 22 to both slide left and behind retainer face plate 26 {c} and engages the right side of the support track {DESCRIBED IN FIG. 6} to the dual action door assembly's right side fully closed position {a}.

In FIGS. 5-{a} through {f}, a multi-action six panel unit door assembly is depicted in the fully closed position {a} though the sliding action of the end sliding panel unit 29 horizontally left to behind the center sliding panel unit 28 {b} {c} and then the end sliding panel unit 29 with the center sliding panel unit 28 together sliding horizontally left to a position behind hinged panel unit 27 {d} {e}. Further, though the sliding action of the end sliding panel unit 30 horizontally right to behind the center sliding panel unit 31 {b} {c} and then the end sliding panel unit 30 with the center sliding panel unit 31 together sliding horizontally right to a position behind hinged panel unit 32 {d} {e}. And then with the sliding panel units 29-28 and the hinged panel unit 27 locked together and with the sliding panel units 30-31 and the hinged panel unit 32 locked together through the hinged swinging 180 degree action to the left side and the right side of the doorway to the door assembly's fully open position {e} {f}.

Typical wide doorways include different doorway widths. Usually up to a maximum doorway width of about 84" use dual conventional doors that open from the center of the doorway with one opening to the left and one opening to the right. It is not practical to use wider conventional doors because the swing radius would be too large and it would take up too much wall space when the doors are left open. These problems would be compounded by probable sag because of the large doors weight and lack of support considering the only support would be on the hinged vertical edge of the door. . A wider doorway often is desirable but not practical therefore a compromise is created by using a narrower door. The new invention, if a six panel unit door assembly is employed, reduces the swing radius to approximately 33% of the conventional door and therefore makes it practical for a wider doorway to be installed. Further, a six panel unit door assembly requires less wall space on both sides of the doorway. An example would be a wide doorway that is 120" wide. One option would be to use a four panel unit door assembly with each panel 30" wide with a swing radius and wall space requirement of 30" on both sides of the door compared to another option that would be to use a six panel unit door assembly with each panel 20" wide with a reduced swing radius and wall space requirement of 20" on both sides of the door therefore making a wide door 120" now practical. Further, a new invention six panel door assembly would further reduce the swing radius and wall space requirements.

In order to achieve this result, end sliding panel unit 29 is connected to center sliding panel unit 28 which in turn is connected to hinged panel unit 27 with a connecting slide mechanism {DESCRIBED IN FIG. 7} and end sliding panel unit 30 is connected to center sliding panel unit 31 and center panel 31 is connected to hinged panel unit 32 with another connecting slide mechanism {a}. To open the door, one would move end sliding panel unit 29 horizontally left to behind center sliding panel unit 28 {b} and then with end sliding panel unit 29 behind center sliding panel unit 28 {c} together to a position behind hinged panel unit 27 {d} and move end sliding panel unit 30 horizontally right to a position behind center sliding panel unit 31 {b} and then sliding panel units 30-31 together {c} {d} to a position behind hinged panel unit 32 {c} {d} {e}. In addition, with end sliding panel unit 29 behind center sliding panel unit 28 together slides horizontally left behind hinged panel unit 27, end sliding panel unit 29 disengages from the support track {DESCRIBED IN FIG. 6}{e} and together both sliding panel units 28-29 along with hinged panel unit 27 are now free to swing rotate out from behind the left side of retainer face plate 35A {e} {f} to the fully 180 degree open position Further with end sliding panel unit 30 behind center sliding panel unit 31 together slides horizontally right behind hinged panel unit 32, end sliding panel unit 30 disengages from the support track {DESCRIBED IN FIG. 6}{e} and together both sliding panel unit 30-31 along with hinged panel unit 32 are now free to swing rotate out from behind the right side of retainer face plate 35A {e} {f} to the fully 180 degree open position. With both the left and right door unit assemblies open 180 degrees out of the doorway, the doorway if fully open with 100% unrestrictive access. Further, at the beginning of the swing rotation cycle {e}, sliding panel units 28-29 and hinged panel unit 27 are automatically locked together by the magnetic/gravity lock bar mechanism {DESCRIBED IN FIG. 7}. End sliding panel unit 30 and center sliding panel unit 31 and hinged panel unit 32 are likewise locked together at the beginning of the rotation cycle {e} {f}.

Noted also is that when the door action is reversed in the process of closing the door at the time of swing rotation completion {e} the magnetic/gravity lock bar mechanism {DESCRIBED IN FIG. 7} automatically unlocks the sliding panel units 28-29 from hinged panel unit 27 freeing sliding panel units 28-29 to slide right and behind retainer face plate 35A {c} {DESCRIBED IN FIG. 6} and engages the left side of the support track {DESCRIBED IN FIG. 6} to the multi action door assembly's left side fully closed position {a}. Also is that when the door action is reversed in the process of closing the door at the time of swing rotation completion {c} the magnetic/gravity lock bar mechanism {DESCRIBED IN FIG. 7} automatically unlocks the end sliding panel unit 30 from the center sliding panel unit 31 and from hinged panel unit 32 freeing end sliding panel unit 30 and center sliding unit 31 to both slide left and behind retainer face plate 35A {c} and engages the right side of the support track {DESCRIBED IN FIG. 6} to the dual action door assembly's right side fully closed position {a}.

In FIGS. 6-{a} through {x} the new invention weight support and alignment mechanism is depicted for a two panel unit door assembly {c} {f} {g} {h} {j} and for a three panel unit door assembly {b} {e} {{h} {i} {k}. It should be noted that these two panel unit depictions are intended to cover an entire door assembly and either the left side and/or right side of a door assembly that has more than one panel unit assembly of which at least one is a two panel door assembly or a three panel door assembly whichever is applicable. The drawings depicting the support and alignment mechanism for a two panel unit door assembly are applicable to a two panel unit door assembly {j}, a four panel unit door assembly consisting of two two panel unit door assemblies one on the left side and on the right side of the door {l}, and a five panel unit door assembly where one side of the door uses a two panel unit door assembly and the other side uses a three panel unit door assembly {m}. The drawings depicting the support and alignment mechanism for a three panel unit door assembly are applicable to a three panel unit door assembly {k}, a five panel unit door assembly where one side of the door uses a three panel unit door assembly and the other side uses a two panel unit door assembly {m}, and a six panel unit door assembly that consists of two three panel unit door assemblies one on each side of the door {n}.

Typical conventional hinged doors support the door weight vertically along the door edge that contains the hinges. All of the doors weight support is applied to the hinges connecting the door to the door frame or door jamb. Adequate support is determined by the quantity of and/or size and strength of the hinges and size and material of the door frame in addition to the screw type size and strength. However, the weight distribution in relation to the distance from the vertical hinge edge is a significant factor. The more door weight farther away from the vertical hinge edge the more tendencies for the door to sag therefore the wider the door, without additional support, the more tendencies for the door to sag especially over time. The new invention door support and alignment mechanism solves this problem so that regardless of the new invention practical door width, the necessary support and alignment is present over the entire width of the doorway with the door fully open, partially open or completely closed.

In order to achieve this result, the support and alignment mechanism comprises several components and characteristics that work in unity to share the weight and alignment burden. It should be noted that the weight support requirements change with the door in a fully open position to the door in a fully closed position especially on wide doors. First, as shown in FIG. 7-{d} item 54 a rabbet cutout the full width of the door panel unit supports the weight and controls the alignment of the slide mechanism 58 FIG. 7-{d} and the connecting door panel unit 48 FIG. 7{e}. In the case of a two panel unit door assembly, the rabbet cutout is located in the hinged door panel unit therefore it supports the sliding panel unit and controls the alignment of the two before mentioned panel units FIG. 6 {a} {c} {d} {f} {g}. In the case of a three panel unit door assembly the rabbet cutout is located in the hinged door panel unit 43A FIG. 6{i} and the center sliding panel unit 45 FIG. 6{i} and therefore two slide mechanisms 50 FIG. 6{i} are used with the slide mechanism and the rabbet cutout of the hinged panel unit 43A FIG. 6{i} supporting the weight of two slide mechanisms 50 FIG. 6{i} and two sliding panel units 42A-45 FIG. 6{i} and the slide mechanism and rabbet cutout in the center sliding panel unit 45 FIG. 6{i} supporting the weight and controlling the alignment of the end sliding panel unit 42A FIG. 6{i}. It should be noted that with the sliding panel units all behind the hinged panel unit the weight and alignment of the sliding panel units is evenly distributed for the full width of the panel units as a result of the slide mechanism in the closed position and that the slide mechanism(s) rest on the rabbet cutout(s). Standard slide mechanisms are usually load rated based on the average length of the slide mechanism. For example, standard slide mechanisms are available commercially in lengths that range from approximately 16" to 36". A slide mechanism load rating is based the construction size and types of materials used. The slide mechanism has the highest load rating when it is closed to its shortest length and lowest rating when it is fully extended. In its fully extended position, excessive weight will cause the mechanism to sag proportionately. Therefore, with the sliding panel units all behind the hinged panel unit, the slide mechanism(s) are in a position of maximum strength with weight approximately evenly distributed to prevent sagging of the panel units. Further, because the full weight of the panel units are at their closest proximity to the vertical hinge connections to the door frame, sagging can be avoided with adequate size and quantity of hinges and screws connected to an adequately strength door frame.

In a two panel unit door assembly such as shown as the left side of a four unit panel door assembly when the sliding panel 41 FIG. 6{d} begins to move horizontally from out and behind the hinged door panel 40, the sliding door panel 41 engages the flat support track 39 which is connected to the door frame header 35 by the back plate 37 as shown in FIG. 6{d} {g} {h}. In relation to the door construction the location of the roller wheel 38 is shown in FIG. 6{j} which is in the upper right corner of the back side of the sliding door on a two panel unit door assembly {g} that hinges open to the left side of the doorway. In comparing a two panel unit door assembly that swings open to the right side of the doorway, the roller is located on the upper left corner of the back side of the sliding door. It should be noted that a two panel unit door assembly obtains its support from the combined effort of the support components within the support mechanism and that the two panel unit door assembly therefore is supported on both the right side and the left side of the door assembly when the sliding panel unit is in a partially open or fully closed position with the slide mechanism partially extended or fully extended. With consideration given to a two panel unit door assembly or any multi-panel unit assembly that incorporates one or more two panel unit door assemblies, support is derived on one side of the door from the hinge connection to the door frame and the other side from the sliding panel unit roller and support track mechanism FIG. 6{g} and from the slide mechanism 50 connecting the two panel units together.

In a three panel unit door assembly when the end sliding panel FIG. 6{e} and FIG. 6{k} begins to move horizontally from out and behind the hinged door panel, the end sliding door panel engages the flat support track 39 which is connected to the door frame header 35 by the back plate 37 as shown in FIG. 6{h}{i}{e}. A three panel unit door assembly requires two support rollers as shown in FIG. 6 38 {e} {m} {n} both connected to the end sliding panel unit. The location of the two rollers 38 is shown in FIG. 6{m}{n} which is in the upper right corner and upper left hand corner of the back side of the end sliding panel units on a three panel unit door assembly. It should be noted that when a three panel unit door has its sliding door panel(s) part way open or full closed during which time the sliding mechanisms 50 are partially or fully extended, each panel unit derives its support from various components within the overall support and alignment mechanism. To expand on this, with the door part way open or fully closed, the hinged panel unit obtains most of its support from the hinge connections to the door frame. The end sliding panel unit obtains its support from the two rollers 38 riding on the horizontal track 39 connected to the back plate 37 and then to the door frame header 35 and the center sliding panel unit obtains its support on one side from the slide mechanism 50 connection to the hinged panel unit connected to the door frame and to its other slide mechanism 50 connection to the end sliding panel unit with two rollers 38 engaged on the support track 39 on the other side FIG. 6{i}. It should be noted that because of the combined support component connections on both sides of a multi-panel unit door assembly the door is supported approximately equal throughout its full travel range and therefore avoids the problems of sagging regardless of the doors overall practical wide width.

In FIGS. 6{o} and {p}, two alternate constructions are shown for components that can be used within the new invention support mechanism. In FIG. 6{o} a roller assembly is depicted that consists of basically three parts with 44 mounting plate 38 roller and 38A roller pin connecting the parts with clearances to allow for the roller to rotate as a wheel. In FIG. 6{p} a alternate solid one piece component made of a material with a low drag coefficient such as Teflon, or nylon or UHMW plastic. Either of these components could be utilized within the support mechanism to engage on the top of the support track depending on the door assembly application. For example, a larger heavier multi-panel unit door assembly could use the roller assembly {O} for smoother door sliding action with less slide resistance. The solid component {p} would be more cost effective and simpler for a smaller lighter weight multi-panel unit door assembly.

Both roller assembly and solid slide component are adjustable vertically. In the process of attachment and adjustment only two holes would be used with screws for example 44A1 and 44A2 in {p} would be used together to keep either {o} or {p} solid component or roller assembly horizontal to attach it to the door panel unit. To site an example of an adjustment to raise the door assembly the two screws could be removed from holes 44A1 and 44A2 and the solid component or roller assembly repositioned so the two screws would use holes 44B1 and 44B2 instead resulting in the roller assembly or solid component moving down which in turn would raise the door assembly up. The mounting screw holes in the door panel unit would be reused. During this vertical adjustment, the roller assembly {o} or solid component {p} would move horizontally left or right which is allowable as it has no operational effect on the adjustment objective. Further, with this method of adjustment, the adjustment is fixed and cannot move out of adjustment.

FIGS. 6 [q} two panel unit door assembly {r} three panel unit door assembly {t} T-shaped cutout groove show alternate support methods in place of a commercial slide mechanism (s). As discussed earlier, a slide mechanism is positioned onto the top flat surface of a rabbet cut out in the back side of the hinged door panel unit and therefore obtains additional support strength. Alternate cutouts are depicted in FIGURES {t} 63 a T-shaped cutout groove and {u} 65 a rabbet cutout with a integral roller retaining wall and {v} 66 a rabbet cutout with a separate flat retaining roller wall 67 that is mounted on. The alternate FIG. 6{t} utilizes a T-shaped slot cutout 63 in the backside of the hinged panel unit near the top of the panel unit as depicted in both a two panel unit door assembly and a three panel unit door assembly. In a two panel door assembly, the sliding panel unit 60 FIG. 6{q} is positioned behind the hinged panel unit 59 and connected with roller assemblies FIG. 6{o} and FIG. 6{s}. The T-Shaped cutout and roller assemblies can be at the top of the door assembly or at the top and the bottom of the door assembly. The sliding panel unit will roll horizontally behind the hinged panel unit supported by the rollers 64. FIG. 6{w} shows the relative locations in elevation view with 64 two rollers at the top of the sliding panel unit mounted on the front side on opposite corners and another roller 64 at the bottom on the front side of the sliding panel unit on left bottom corner in a door assembly that swings open to the left side of the doorway. And it should be noted that the bottom 64 roller is located on the right bottom corner of the sliding panel unit in a door assembly that swings open to the right side of the doorway. In addition another roller FIG. 6{q} 68 engages the header track 65 connected to the door frame header 67 by the back plate 66. FIG. 6{w} shows the location of one roller 68 in elevation view and FIG. 6{q} shows the location in a side view.

In a three panel door assembly, the center sliding panel unit 69 FIG. 6{r} is positioned behind the hinged panel unit 59 and connected with roller assemblies FIG. 6{o} and FIG. 6{s} and the end sliding panel unit 70 FIG. 6{r} is positioned behind the center panel unit 69 and connected with roller assemblies FIG. 6{o} and FIG. 6{s}. The T-Shaped cutout and roller assemblies can be at the top of the door assembly or at the top and the bottom of the door assembly The end sliding panel unit will roll horizontally behind the center sliding panel unit and then both sliding panel units will roll behind the hinged panel unit supported by the rollers 64. FIG. 6{x} shows the relative locations in elevation view with 64 two rollers at the top of the end sliding panel unit mounted on the front side on opposite corners and 64 two rollers at the top of the center sliding panel unit mounted on the front side on opposite corners another roller 64 at the bottom on the front side of the end sliding panel unit and the center panel unit on left bottom corner of each sliding panel unit in a door assembly that swings open to the left side of the doorway. And it should be noted that the bottom 64 roller is located on the right bottom corner of each sliding panel unit in a door assembly that swings open to the right side of the doorway. In addition two rollers FIG. 6{r} 68 engages the header track 65 connected to the door frame header 67 by the back plate 66. FIG. 6{x} shows the location of two rollers 68 in elevation view both of which are mounted to the end sliding pane unit one in each corner on the back side and FIG. 6{q} shows the location in a side view. It should be noted that FIG. 6{t} T-shaped slot captures and retains the roller assemblies and therefore prevents the sliding panel units from accidentally lifting off the tract. FIGS. 6{u} and {v} constructions do not capture the rollers and both rely on the panel unit weight to remain on track.

In FIGS. 7-{a} through {n}, the new invention panel unit bar locking mechanism is depicted for a two panel unit door assembly {a} {b} {c} {d} {e} {f} and for a three panel assembly {d} {g} {{h} {i}. It should be noted that these depictions are intended to cover an entire door assembly and either the left side and/or right side of a door assembly that has more than one panel unit assembly of which at least one is a two panel door assembly or a three panel door assembly whichever is applicable. The drawings depicting the bar locking mechanism for a two panel unit door assembly are applicable to a two panel unit door assembly FIG. 6{j}, a four panel unit door assembly consisting of two two panel unit door assemblies one on the left side and on the right side of the door FIG. 6{l}, and a five panel unit door assembly where one side of the door uses a two panel unit door assembly and the other side uses a three panel unit door assembly FIG. 6{m}. The drawings depicting the bar locking mechanism for a three panel unit door assembly are applicable to a three panel unit door assembly FIG. 6{k}, a five panel unit door assembly where one side of the door uses a three panel unit door assembly and the other side uses a two panel unit door assembly FIG. 6{m}, and a six panel unit door assembly that consists of two three panel unit door assemblies one on each side of the door FIG. 6{n}.

A combination sliding panel unit and hinged panel unit door has the potential for the sliding panel unit(s) to slide out from behind the hinged panel unit at a time or in a position not desirable whereby it could cause injury to a person, damage to objects or to walls or construction or damage to the door assembly itself should it occur. For example, if a person is holding on to the sliding panel unit behind the hinged panel unit while rotating the panel units open and with the swinging action already beyond the safety of the retaining face plate, if the sliding panel unit suddenly began the sliding action the person could lose ones balance and fall over or if the sliding panel unit could collide with the person causing injury. Further, because of the nature of a wide door, the door requires adequate weight support, therefore, if the sliding panel unit(s) were allowed to slide out from behind the hinged panel unit without the benefit of the full supporting roller assembly and track mechanism, the reduced support could cause door assembly sag damage with the slide mechanisms extended and therefore at their lowest strength rating.

The new invention door assembly panel unit bar locking mechanism solves this problem so that the sliding panel unit (s) will only slide from behind the hinged panel unit when the door assembly is parallel to the doorway in the closed position and in the doorway aligned with the horizontal travel direction to behind the retaining face plate. From this position the sliding panel units will slide closed. However, if the door is to be deliberately swing rotated open, as soon as this swing action is started, the hinged panel unit and the sliding panel unit(s) automatically lock together preventing the sliding panel unit(s) from sliding out from behind the hinged panel units. The automatic panel unit bar locking mechanism will retain the door assembly in this locked position throughout the 180 degree swing open action to the fully open position, will hold the locking action indefinitely and will only release the lock bar when the swing action of the locked together panel units is swing rotated back into the doorway in the closed position and aligned for horizontal sliding action. The release of the bar locking mechanism is also automatic when the door assembly completes the return rotation process.

In order to achieve this result, the panel unit bar locking mechanism comprises several components and characteristics that work together to automatically lock the sliding panel unit to the sliding panel unit(s) and to automatically unlock the panel units from one another.

FIG. 7 {a} {b} {c} show a two panel unit door assembly bar locking mechanism. The lock bar assembly consisting of the lock bar FIG. 7 {a} {b} {c} 51 and lock bar pivot pin 52 are located on the top edge of the hinged door unit close to the corner opposite the hinged edge. The magnet 47 is located directly above the lock bar 51 in the door frame header 46. The wedge stop component 53 is aligned with the lock bar and attached to the top edge of the sliding panel unit.

FIG. 7 {g} {h} {i} shows a three panel unit door assembly bar locking mechanism. The lock bar assembly consisting of the lock bar FIG. 7 {g} {h} {i} 51 and lock bar pivot pin 52 are located on the top edge of the hinged door unit close to the corner opposite the hinged edge. The magnet 47 is located directly above the lock bar 51 in the door frame header 46. Two wedge stop components 53 are aligned with the lock bar and one stop component is attached to each of the two sliding panel units on the top edges. Lock bar 51 shown in FIG. 7 {d} is constructed of solid magnetic material such as carbon steel or type 400 magnetic stainless steel and incorporates a round through-hole close to one end. With pivot pin 52 containing adequate clearance inserted through the hole in the lock bar 51 said lock bar is allowed to rotate on the pin in an upward direction 55.

Reference is given to FIG. 7 {d} showing a cutout mortise cavity 56 in the top edge of hinged panel unit near the corner opposite of the hinged door edge. The mortise cavity is a vertical cutout and is perpendicular to the top edge of the hinged panel unit. The said vertical mortise cavity is penetrated with a round hole that begins in the vertical edge of the panel unit and runs perpendicular to and through the vertical mortise cavity 56 and parallel to the top edge of the panel unit. The mortise cavity 56 accommodates the placement of the lock bar 51 secured in place in the mortise cavity with the pivot pin 52 allowing the lock bar 51 to rotate freely on the pivot pin from approximately the top resting position of the slide mechanism 58 upward.

Once the lock bar 51 and pivot pin 52 are installed in the hinged panel unit with the door assembly installed in the door frame FIG. 7 {a} {c}, the lock bar 51 is actuated by two alternating forces. One force is gravity which is inherent in the lock bar construction with the pivot point or pivot hole close to one end of the lock bar and the majority of the lock bar component weight on one side of the pin hole. The other force is magnetic force which is generated by the magnet 47 imbedded in the door frame header 46. The forces are applied alternately to the lock bar 51 with reference to the position of the hinged panel unit. First with the hinged panel unit in the closed position within the doorway frame, the end of the lock bar opposite the end with the pivot hole 51 is positioned directly under the embedded door frame header 46 magnet 47. The force of magnet 47 lifts and holds the lock bar 51 in the raised position above the wedge stop component attached to the sliding panel unit(s) as shown in FIG. 7 {c} allowing the sliding panel unit(s) freedom to slide left and right horizontally. Second when the sliding panel unit(s) are positioned directly behind the hinged panel unit, the sliding panel unit(s) has been disconnected from the roller track and is out from behind the retaining face plate and is therefore free to swing open combined with the hinged panel unit. Within less than the first one inch of swing rotation travel, the lock bar 51 is moved away from magnet 47 to a point where the magnetic force connection is broken at which time the gravity force pulls the lock bar 51 down in front of wedge stop component 53 as shown in FIG. 7 {e}. With the lock bar 51 in the lower position and in front of the wedge stop component 53 which is attached to the sliding panel unit(s), the sliding panel unit(s) are prevented from all horizontal movement and therefore locked behind the hinged panel unit. The panel units remain locked together throughout the full 180 degree swing rotation and back as a result of this slide movement blockage. Releasing the automatic lock bar requires that the door panel units locked together be swing rotated to a position whereby they are within the door frame in a closed position. Within the last one inch of travel in closing, the lock bar 51 moves into the force range of the magnet 47 and reacts to the magnetic force by raising to connect with the magnet. With the lock bar 51 now in the raised position, it ceases to block the wedge stop component attached to the sliding panel unit(s) and therefore the sliding panel unit(s) are free to move horizontally left and right.

It should be noted that the wedge stop component 53 is constructed with a ramp on one end to facilitate door maintenance or adjustment to the door assembly. In such a case, the lock bar can be raised manually to allow the sliding panel unit(s) to move out from behind the hinged panel units when the door assembly is not in the closed door frame position. Once said maintenance is performed the sliding panel unit(s) can be moved behind the hinged panel unit and the lock bar 51 will slide up the ramp and reset or reposition itself in the locked panel position before closing the attached panel units into the door frame.

Two alternate bar locking constructions are depicted in FIG. 7 {j} {k} {l} as a gravity linear engaging mechanism and FIG. 7 {m} {n} {l} as a spring force linear engaging mechanism. Both of the alternate lock bar mechanisms function in the same manner as the magnetic/gravity lock bar mechanism except for some force changes to raise and lower the lock bar. Both alternate lock bar mechanisms replace magnetic raising force with a linear engaging force to raise the lock bar whereby FIG. 7 {j} item 60 and {m} item 60 lock bars are impacted by stationary member 61 mounted onto the header 46 at such a time when the hinged panel unit connected to applicable sliding panel units are rotating closed into the doorway. In both constructions, the member 61 contacts the lock bar 60 and forces the end closest to the lock bar pivot pin 52 downward and therefore the lock bar long end upward and holds it upward above the wedge stop component 53 as long as the hinged panel unit remain in the closed position within the doorway allowing the sliding panel(s) to horizontally slide closed. Further, when the hinged panel unit and sliding panel units are rotated out of the doorway, the lock bar long end will drop by gravity force and block the wedge stop 53 component and lock the panel units together with the gravity linear engaging mechanism. In the case of the spring force linear engaging lock bar mechanism FIG. 7 {m} spring 63 located between the bottom of the lock bar short end 60 and the bottom of the mortise cutout 56 once the hinged panel unit and sliding panel unit(s) begin to rotate out of the doorway, the spring force will force the short end of the lock bar 60 upward and therefore the long lock bar end downward to block the wedge stop 53 to lock the panel units together.

It should be noted that as described within the magnetic/gravity lock bar mechanism, the two alternate lock bar mechanisms are applicable for a two panel unit door assembly or a three panel unit door assembly as well.

Reference is given to FIG. 7 {a} {c} to illustrate a two panel unit with one sliding panel unit and one wedge stop component 53. FIG. 7 {g} {h} {i} illustrate a three panel unit with two sliding panel units and two wedges stop components 53 It will thus be seen that the object set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A dual action combination slide and swing door comprising:

a first door panel unit hinged to a vertical door frame jamb using hinges secured to the jamb with hinge screws;

a second door panel attached to the first door panel, creating a two-panel connected door assembly, in a plane adjacent and parallel to the first door panel with a drawer slide mechanism between the two door panels screwed together so that the second door panel would move in parallel slide or rolling movement from a partial overlapping position to a full overlapping position or in addition to the two-panel assembly a third panel attached to the second panel creating a three-panel connected door assembly, in a plane adjacent and parallel to the second door panel with another conventional drawer slide mechanism between the second door panel and the third door panel connected in the same manner so that the third door panel could move in a parallel slide or rolling movement in relation to the second door panel from a partial overlapping position to a full overlapping position;

a roller assembly that is attached to the second door panel and a corresponding mating partial length flat support track attached to and along a door frame top horizontal member if a two door panel unit assembly or two or more roller assemblies attached to the third door panel if the door assembly consists of three panel units;

a magnetic and gravity locking bar assembly that automatically blocks and unblocks the second door panel unit of a two door panel assembly from sliding or rolling action or blocks and unblocks the second and third door panel units of a three door panel assembly from sliding or rolling action comprising a permanent magnet mounted on the top horizontal member and a lock bar mounted on one of the panels;

whereby the second or second and third door panels roll from a partial overlapping position to the full overlapping position relative to the first hinged door panel when the first door panel is positioned in and parallel to the doorway frame and to one another and only from this fully overlapped position allowed to pivot rotate out from the doorway;

whereby starting from the fully overlapped position of the second door panel or the second and third door panels relative to the first hinged door panel when the first door panel is located in the door frame parallel with the frame at the start of the rolling action to a partial overlapping position, the roller assembly or assemblies, aligned with the corresponding flat track attached to the top door frame horizontal member, engages said track by rolling onto said track allowing for said track to assume partial weight support of the second or second and third rolling door panels with the amount of door weight support increased in relation to the amount of decreasing overlap and with the opposite weight bearing affect occurring to the point whereby the roller disengages from the track;

whereby with all of the door panels overlapping one another fully relative to the hinged door panel when located in and parallel with the doorway frame, the two door panels or three door panels will rotate out of the doorway frame and during the start of the rotation within less than the first one inch of rotation travel, the lock bar component of the lock bar assembly once the panels are rotated and the lock bar is no longer attracted to the magnet, will drop down and block the second or second and third door panels from any rolling action during rotation, and the blocking action will remain fixed until the two or three door panels are rotated back into within less than the last one inch of rotation travel to a position where the magnet will attract and raise the lock arm, thereby disengaging the door panel lock bar from blocking the rolling action of the rolling door panel or panels.

2. The dual action door assembly of claim 1, wherein the partially engaged flat support track, comprising:

a roller wheel attached to the second door panel or in the case of a three panel door assembly, two roller wheels attached to the third door panel;

a flat roller track attached to the door frame horizontal member.

3. The dual action door assembly of claim 1, wherein the magnetic and gravity locking bar assembly further comprising, a metal locking bar with a pivot pin hole in one end that rotates up by the pull of the magnetic force from the permanent magnet mounted in the door frame top horizontal member when the lock bar is directly under said magnet therefore disengaging the blocking action of the second or second and third door panel units and pivot down as a result of gravity force when it pivots out of the magnetic field during the door rotation action therefore engaging in said blocking action;

a mounting bracket that allows for mounting the pivot bar to the hinged door panel;

a pivot pin that connects the locking bar and the mounting bracket which allows the bar to pivot up or down in the mounting bracket after assembled onto the door;

a wedge stop that is mounted on the top edge of the sliding door panel at a position whereby when the lock bar drops down on its pivot when the door is rotated out of the doorway and out of the magnetic field, it blocks the rolling action of the rolling door panel:

the permanent magnet is mounted into the door frame horizontal member directly above the non-pivot end of the lock bar.

* * * * *